US005418324A

United States Patent [19]

Konishi et al.

[11] Patent Number: 5,418,324

[45] Date of Patent: May 23, 1995

[54] AUTO-PLAY APPARATUS FOR GENERATION OF ACCOMPANIMENT TONES WITH A CONTROLLABLE TONE-UP LEVEL

[75] Inventors: Shinya Konishi; Yoshihisa Shimada, both of Hamamatsu, Japan

[73] Assignee: Kabushiki Kaisha Kawai Gakki Seisakusho, Shizuoka, Japan

[21] Appl. No.: 320,842

[22] Filed: Oct. 7, 1994

Related U.S. Application Data

[63] Continuation of Ser. No. 46,483, Apr. 9, 1993, abandoned, which is a continuation of Ser. No. 842,711, Feb. 27, 1992, abandoned.

[30] Foreign Application Priority Data

| | | | |
|---|---|---|---|
| Feb. 28, 1991 | [JP] | Japan | 3-058188 |
| Feb. 28, 1991 | [JP] | Japan | 3-058189 |
| Feb. 28, 1991 | [JP] | Japan | 3-058190 |
| Feb. 28, 1991 | [JP] | Japan | 3-058191 |

[51] Int. Cl.[6] ..... G10H 1/06; G10H 1/38; G10H 1/42; G10H 1/46

[52] U.S. Cl. ..... 84/611; 84/613; 84/622; 84/633; 84/DIG. 12

[58] Field of Search ..... 84/609–620, 84/622–638, 649–669, 477 R, 478, DIG. 12, DIG. 22

[56] References Cited

U.S. PATENT DOCUMENTS 4,646,609 3/1987 Teruo et al. ..... 84/609 X

*Primary Examiner*—Stanley J. Witkowski

[57] ABSTRACT

An auto-play apparatus associated with a keyboard instrument is arranged for generating auto-accompaniment tones such as chord, bass drum lines to have a specific rhythm pattern. When a player determines tone-up of a music piece during a performance, he or she operates an intonation dial (22) arranged on an operation panel (2) or an expression pedal (23). Then, an intonation value representing a tone-up level of the music piece is generated as numerical value information. A corresponding play pattern is read out from an auto-accompaniment pattern ROM (6) according to the intonation value and a rhythm pattern selected in advance upon operation of an operation member of the operation panel (2), thus starting an auto-play operation. Auto-accompaniment pattern data corresponding to the intonation value is programmed to change the play pattern according to a tone-up state of a music piece during the performance of the music piece.

48 Claims, 37 Drawing Sheets

FIG. 6

| RHYTHM | INTONATION PRESET VALUE |
|---|---|
| 1 | 2 |
| 2 | 4 |
| 3 | 3 |
| ------ | ------ |

41

FIG. 7

| RHYTHM | INTONATION PATTERN | | | | |
|---|---|---|---|---|---|
| | 0 | 1 | 2 | ------ | 15 |
| 1 | | | | ------ | |
| 2 | | | | ------ | |
| 3 | | | | ------ | |
| ------ | | | | ------ | |

34a

42

FIG. 9

43

| | INTONATION 0 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 01H,NC | 0000H | | 0001H | | 0002H | | 0003H | | REP |
| BASE | 00H | 40HNC | 0100H | | | | 101H | | | | REP |
| DRUM1 | 00H | 00H,00H | 1000H | REP | | | | | | | |
| DRUM2 | 00H | 00H,00H | 1100H | | 1101H | | 1102H | | 1103H | | REP |
| DRUM3 | 00H | 00H,00H | 1200H | | 1201H | | 1202H | | 1203H | | REP |

| | INTONATION 2 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 01H,NC | 0000H | | 0001H | | 0002H | | 0003H | | REP |
| BASE | 00H | 40HNC | 0102H | | | | 103H | | | | REP |
| DRUM1 | 00H | 26H,28H | 1000H | REP | | | | | | | |
| DRUM2 | | 00H,00H | 1100H | | 1101H | | 1102H | | 1103H | | REP |
| DRUM3 | 00H | 00H,00 | 1200H | | 1201H | | 1202H | | 1203H | | REP |

45

FIG. 10

47

| | INTONATION 4 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 20H,NC | 0000H | | 0001H | | 0002H | | 0003H | | REP |
| BASE | 00H | .40HNC | 0102H | | | | 103H | | | | REP |
| DRUM1 | 00H | 26H,28H | 1000H | REP | | | | | | | |
| DRUM2 | 20H | 24H,25H | 1100H | | 1101H | | 1102H | | 1103H | | REP |
| DRUM3 | 00H | 00H,00H | 1200H | | 1201H | | 1202H | | 1203H | | REP |

| | INTONATION 6 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 20H | 20H,NC | 0004H | | 0005H | | 0006H | | 0007H | | REP |
| BASE | 20H | 40HNC | 0104H | | | | 105H | | | | REP |
| DRUM1 | 20H | 26H,28H | 1000H | REP | | | | | | | |
| DRUM2 | 20H | 24H,25H | 1104H | | 1105H | | 1106H | | 1107H | | REP |
| DRUM3 | 20H | 00H,00H | 1204H | | 1205H | | 1206H | | 1207H | | REP |

49

ON-EVENT PROCESS.
259
PHRASE PLAY MODE
YES
NO
TONE GENERATION
260
261
SET PHRASE NO.(KEY NO.)
262
START PHRASE PLAY
263
CLEAR COUNTER MELODY FLUG
RETURN
OFF EVENT PROCESS
264
PHRASE PLAY MODE
YES
NO
265
TONE OFF PROCESS.
STOP PHRASE PLAY
266
NO
RHYTHM ON
267
YES
NO
AUTO ON
268
YES
NO
INT.≥4
269
YES
SET PHRASE NO.17
270
SET COUNTER MELODY FLUG
271
RETURN

AUTO-PLAY APPARATUS FOR GENERATION OF ACCOMPANIMENT TONES WITH A CONTROLLABLE TONE-UP LEVEL

This application is a continuation of application Ser. No. 08/046,483 filed on Apr. 9, 1993, now abandoned, which is a continuation of application Ser. No. 07/842,711 filed on Feb. 27, 1992, now abandoned.

FIELD OF THE INVENTION

The present invention relates to an auto-play apparatus for an electronic musical instrument, which can perform an auto-play operation according to a degree of tone-up or enhancement of a performance.

DESCRIPTION OF THE PRIOR ART

In an electronic keyboard (e.g., an electronic piano), auto-accompaniment patterns (tone generation note data) such as introduction, fill-in, normal, ending patterns, and the like are stored in advance, and a switch for selecting one of these patterns is operated in correspondence with the progress of a music piece (tone-up condition), thereby inserting a phrase corresponding to the selected pattern during a performance.

For example, switches, as shown in FIG. 3, are arranged on an operation panel. When a variation switch 531 is depressed, one of two LEDs 532 and 533 is turned on. When an "8-beat" switch of rhythm selection switches 534, 535, and 536 on the left side of the LEDs is depressed, an "8-beat1" rhythm pattern is selected when the upper LED 532 is turned on. In this case, when the lower LED 533 is turned on, an "8-beat2" rhythm pattern is selected. An auto-play operation based on a corresponding play pattern is performed according to the rhythm pattern selected in this manner.

Therefore, an auto-play operation performed in the conventional apparatus is determined by a rhythm pattern selected in advance, and the predetermined pattern is used throughout a performance. Therefore, even if a player wants to change play data of the play pattern according to tone-up of a music piece during a performance of the music piece, he or she cannot change the play data.

When a fixed auto-accompaniment pattern is inserted during a performance, the flow of performance becomes discontinuous, and this results in poor tone up performance. More specifically, it is difficult to gradually change an accompaniment pattern according to the tone-up state of the performance.

SUMMARY OF THE INVENTION

The present invention has been made in consideration of the above-mentioned drawbacks, and has as its object to provide an auto-play apparatus, which allows an operator to instruct a tone-up level of a performance, and can obtain auto-accompaniment tones according to the degree of tone-up.

The auto-play apparatus of the present invention has a rhythm selector 1, an intonation dial 2, and an expression pedal 3, as shown in FIG. 1. The rhythm selector 1 and the intonation dial 2 are arranged on an operation panel 12 (FIG. 2; to be described later). The rhythm selector 1 is an operation member for designating a rhythm, and the intonation dial 2 is a dial operated by a player according to the tone-up state of a music piece. The expression pedal 3 is a pedal similarly depressed by a player according to the tone-up state of a music piece.

The tone-up level of the music piece input from the intonation dial 2 and the expression pedal 3 is supplied to a controller 4. The controller 4 generates numerical value information (intonation value) according to the input tone-up level. An auto-accompaniment pattern ROM 6 as a kind of play pattern memory stores various accompaniment patterns corresponding to the rhythm selected by the operation member of the rhythm selector 1 and the intonation value input from the intonation dial 2 or the expression pedal 3. Desired accompaniment pattern data is read out from the ROM 6 according to the input data. A tone generator 8 generates accompaniment tones on the basis of the accompaniment pattern data read out from the auto-accompaniment pattern ROM 6. The tone generator 8 also generates melody tones on the basis of data generated upon depression of keys on a keyboard 11. The melody tones are generated together with the accompaniment tones.

When a player feels the tone-up of a music piece during a performance, he or she turns the intonation dial 2 or depresses the expression pedal 3 according to the degree of tone-up of the music piece. Thus, information from the intonation dial 2 or the expression pedal 3 is supplied to the controller 4, and the controller 4 outputs an intonation value representing the degree of tone-up of the music piece. The auto-accompaniment pattern ROM 6 stores various accompaniment patterns according to rhythms and intonation values. An optimal accompaniment pattern is read out from the ROM 6 according to the rhythm selected upon operation of the operation member of the rhythm selector 1, and the intonation value sent from the controller 4. The tone generator 8 generates accompaniment tones according to the readout accompaniment pattern. Therefore, not only accompaniment tones of an accompaniment pattern corresponding to a rhythm selected in advance upon operation of the operation member of the rhythm selector 1 are generated, but also the accompaniment pattern can be changed according to the degree of tone-up of the music piece during the performance of the music piece.

BRIEF DESCRIPTION OF THE DRAWINGS

FIG. 6 shows a memory table of intonation preset values;

FIG. 7 shows a memory table of intonation pattern data;

FIGS. 9 and 10 show data formats of intonation pattern data;

DETAILED DESCRIPTION OF THE PREFERRED EMBODIMENTS

Figure 1:
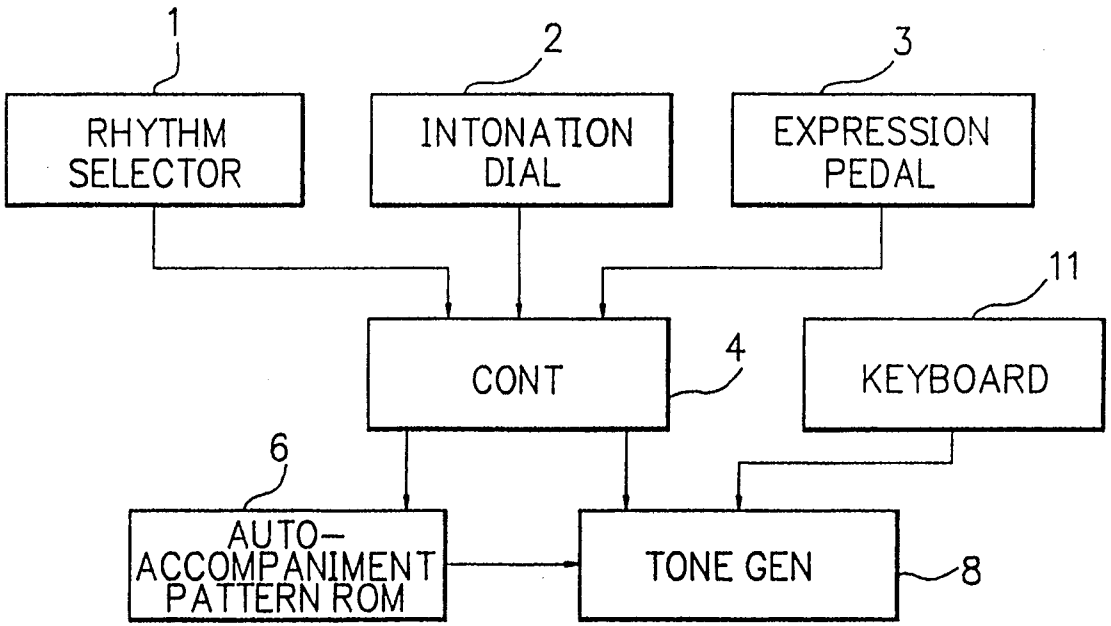
FIG. 1 is a functional block diagram showing elemental features of an auto-play apparatus according to the present invention.
Figure 2:
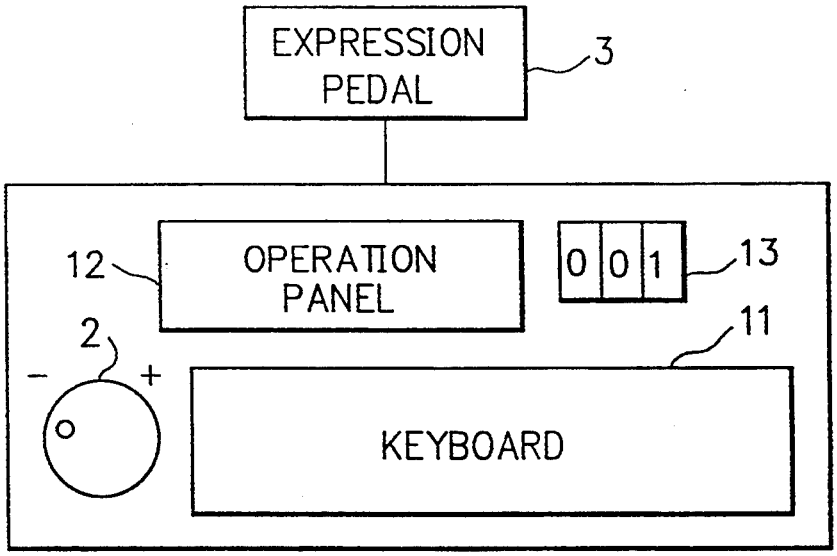
FIG. 2 is a view showing an outer appearance of an electronic musical instrument according to an embodiment of the present invention.
Figure 3:
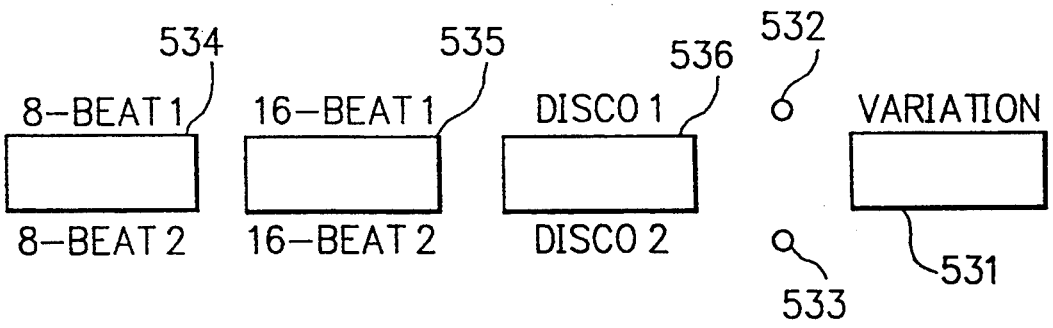
FIG. 3 is a view showing an example of a conventional operation panel.

FIG. 2 shows the outer appearance of an embodiment of an electronic musical instrument using an auto-play apparatus according to the present invention. As shown in FIG. 2, this instrument has a keyboard 11 consisting of a large number of keys. An intonation dial 2, operated according to the degree of tone-up of a music piece, is arranged at the left side of the keyboard 11. Furthermore, an operation panel 12 consisting of a plurality of switches for specifying rhythms, and the like, and a display 13 for displaying information such as the degree of tone-up of a music piece are arranged. An expression pedal 3 is also connected to this instrument.

The keyboard 11 includes a keyboard, and an interface for receiving signals from keys of the keyboard, and the like.

The operation panel 12 includes the plurality of switches for selecting rhythms, a large number of tone color and play control operation members, an interface for receiving signals from the operation members, and the like. A rhythm in an auto-play mode is selected from, e.g., "8 beats", "16 beats", "disco", and the like, and is set by a switch.

The intonation dial 2 in FIG. 2 is an operation member operated by a player when he or she feels the tone-up of a music piece during a performance. When the player turns the intonation dial 2 clockwise, an intonation value is increased; when he or she turns the dial counterclockwise, the intonation value is decreased. When the player feels, based on changes in tone volume, chord, tone color, depth of tone, and the like, that a played music piece has reached its tone-up part, he or she turns the intonation dial 2 according to the degree of tone-up of the music piece. For example, when the degree of tone-up of the music piece is large, the player turns the intonation dial 2 significantly; when it is small, he or she turns the dial slightly. The tone-up information of the music piece input upon rotation of the intonation dial 2 is detected based on the rotational angle of the dial, and is sent as an intonation value to a CPU. As shown in FIG. 2, since the intonation dial 2 is arranged at the left side of the keyboard 11, the player can operate the intonation dial 2 with his or her left hand while playing a melody with his or her right hand.

The expression pedal 3 is an operation member operated with a player's foot like a piano pedal. The expression pedal 3 has a seesaw-like structure. When the player depresses one of the two end portions about the central portion of the pedal as a fulcrum, the degree of tone-up of a music piece is indicated. When the expression pedal is depressed, the value of a resistor (not shown) connected to the pedal is changed, and the resistance is translated into data representing the degree of tone-up of the music piece. The resistance is converted into digital data by an A/D converter (not shown), and the digital data is supplied to the CPU as an intonation value. In this embodiment, when both the expression pedal 3 and the intonation dial 2 are operated, and different intonation values are input from the operation members, the intonation value input from the expression pedal 3 is preferentially processed, and the intonation value input from the intonation dial 2 is ignored. However, the intonation value input from the intonation dial 2 may have a priority over that input from the expression pedal 3.

The display 13 comprises segment LEDs, a liquid-crystal panel, or the like, and displays an intonation value representing the degree of tone-up of a music piece indicated upon rotation of the intonation dial 2 or upon operation of the expression pedal 3 in eight steps ranging from 0 to 7. In FIG. 2, "001" is displayed, and indicates that the intonation value is 1. In place of indication using a digital value ranging from 0 to 7, as shown in FIG. 2, the degree of tone-up of a music piece may be indicated by, e.g., a level meter, in an analog manner.

Figure 4:
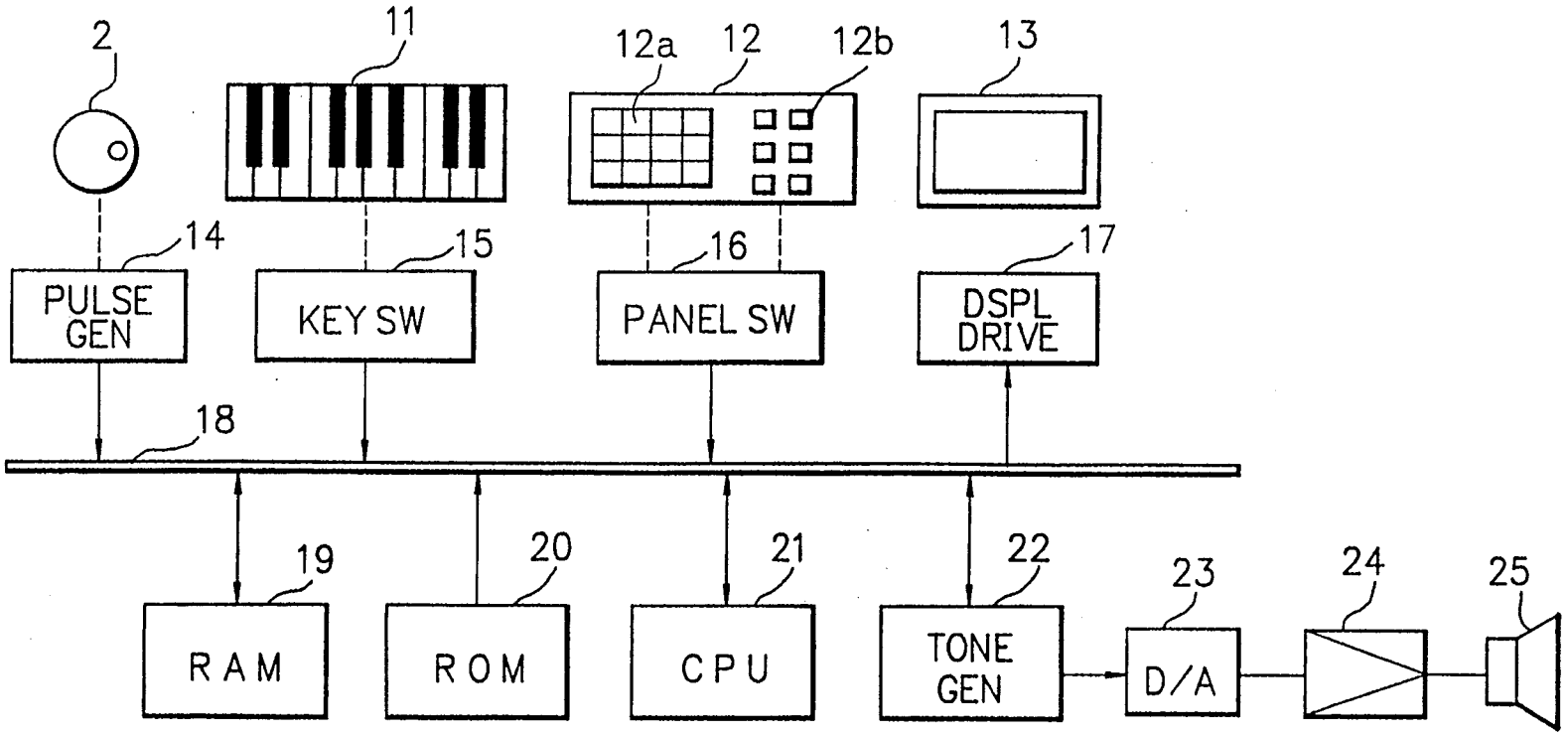
FIG. 4 is a block diagram of an electronic musical instrument as an embodiment of an auto-play apparatus according to the present invention.

FIG. 4 is a block diagram of principal part of the electronic musical instrument according to the embodiment of the present invention. The electronic musical instrument comprises the keyboard 11, the operation panel 12, and the display 13. The dial 2 for instructing the degree of tone-up of a performance is arranged aside the keyboard 11.

A circuit section of the electronic musical instrument comprises a microcomputer consisting of a CPU 21, a ROM 20, and a RAM 19, which are coupled through a bus 18. The CPU 21 detects operation information of the keyboard 11 from a key switch circuit 15 connected to the keyboard 11, and detects operation information of panel switches from a panel switch circuit 16 connected to the operation panel 12. The dial 2 is connected to a pulse generator 14, and the CPU 21 counts pulses generated by the pulse generator 14 according to the dial operation, thereby obtaining tone-up degree information (intonation value).

A rhythm and a kind of instrument selected from the operation panel 12, an intonation value corresponding to the dial operation, and the like are displayed on the basis of display data supplied from the CPU 21 to the display 13 via a display drive circuit 17.

The CPU 21 sends note information corresponding to a keyboard operation, and parameter information such as a rhythm, a tone color, and the like corresponding to a panel switch operation to a tone generator 22. The tone generator 22 reads out PCM sound source data from the ROM 20 on the basis of these pieces of information, processes the amplitude and envelope of the readout data, and outputs the processed data to a D/A converter 23. A tone signal obtained from the D/A converter 23 is supplied to a loudspeaker 25 through an amplifier 24.

Auto-accompaniment data is written in the ROM 20. The CPU 21 reads out auto-accompaniment data corresponding to an operation of an auto-accompaniment selection button on the operation panel 12, and supplies the readout data to the tone generator 22. The tone generator 22 reads out waveform data for chord tones, bass tones, drum tones, and the like corresponding to auto-accompaniment data, and outputs the readout data to the D/A converter 23. Therefore, the chord tones, bass tones, and drum tones of an auto-accompaniment are obtained from the loudspeaker 25 together with tones generated in correspondence with key operations.

Figure 5:
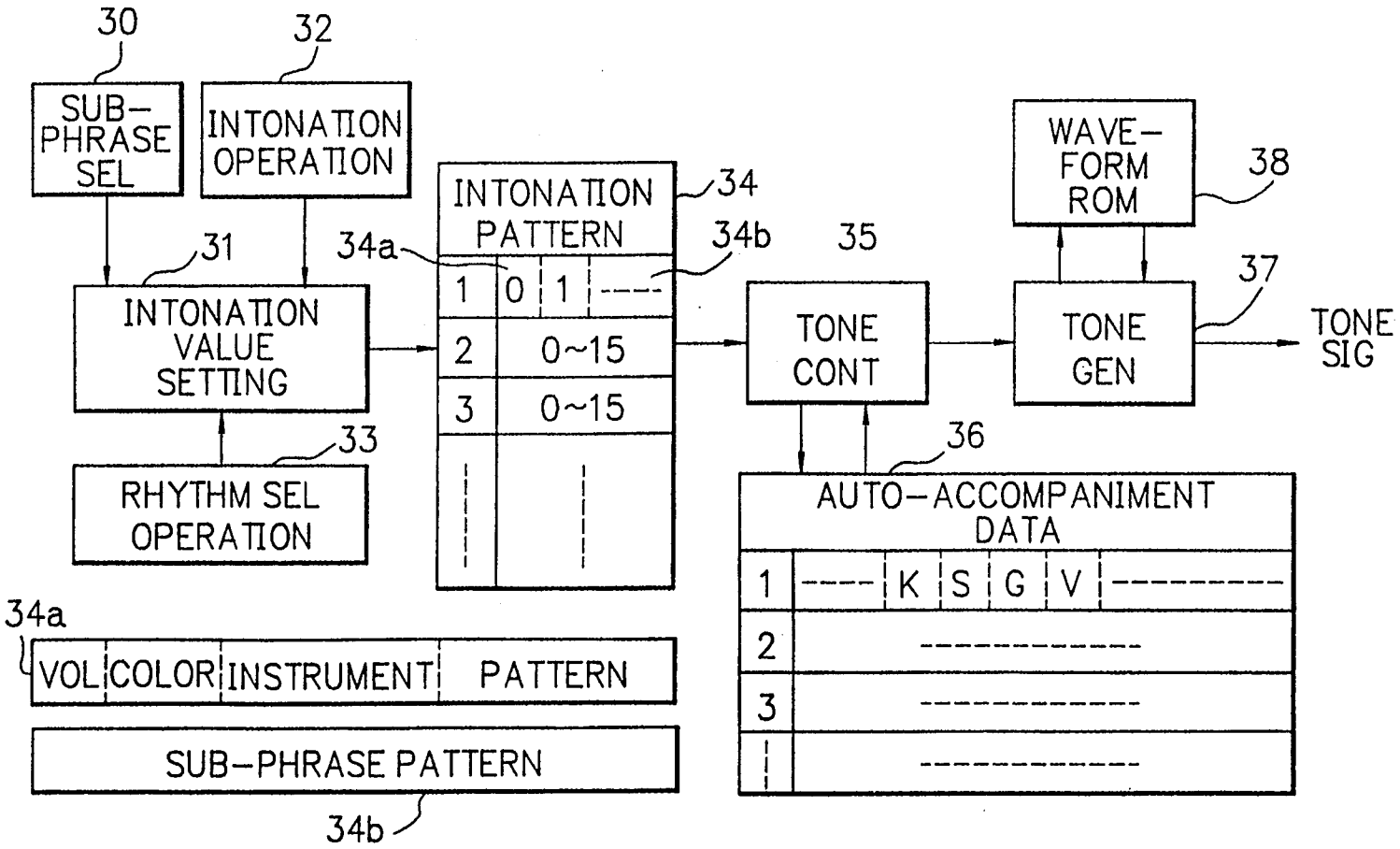
FIG. 5 is a block diagram showing the auto-play apparatus according to the present invention.

FIG. 5 is a block diagram showing elemental features of the embodiment shown in FIG. 4. An intonation operation unit 32 corresponds to the dial 2 and the pulse generator 14 shown in FIG. 4. A rhythm selection unit 33 includes ten-key switches 12*a* arranged on the operation panel 12. The operation panel 12 is provided with a plurality of push-button switches 12*b* for instructing insertion of sub-phrase patterns of short phrases such as an introduction phrase, an ending phrase, a fill-in phrase, and the like. These push-button switches 12*b* constitute a sub-phrase selection unit 30 shown in FIG. 5.

When a player operates the dial 2 according to the degree of tone-up of a performance, output pulses from the pulse generator 14 are supplied to an intonation value setting unit 31. When the player selects a desired sub-phrase pattern at the sub-phrase selection unit 30, corresponding selection information is supplied to the intonation value setting unit 31. A selected rhythm number is supplied from the rhythm selection unit 33 to the intonation value setting unit 31.

The intonation value setting unit 31 has an intonation preset table 41 allocated on the ROM 20, as shown in FIG. 6. The table 41 has intonation preset values in units of rhythms. For example, as for "rhythm 1", a value "2" is given as an intonation level. The intonation value setting unit 31 increases/decreases the intonation preset value according to the dial operation, and outputs the intonation value and the rhythm number to an intonation pattern memory 34.

The intonation pattern memory 34 is allocated on the ROM 20, and has an intonation pattern table 42 having a plurality of levels (e.g., 16 levels from 0 to 15) corresponding to intonation values in units of rhythms, as shown in FIG. 7. Therefore, intonation pattern data 34*a* of a predetermined level corresponding to the selected rhythm and the input intonation value is read out from the memory 34, and the readout data is supplied to a tone control unit 35. For example, if the selected rhythm number is "1", and the intonation value is "2", intonation pattern data 34*a* of corresponding level "2" is read out.

The intonation pattern data is partially used as a sub-phrase pattern 34*b*. The sub-phrase pattern 34*b* is read out when a sub-phrase (short phrase) such as an introduction phrase, an ending phrase, a fill-in phrase, or the like is to be inserted.

Figure 8:
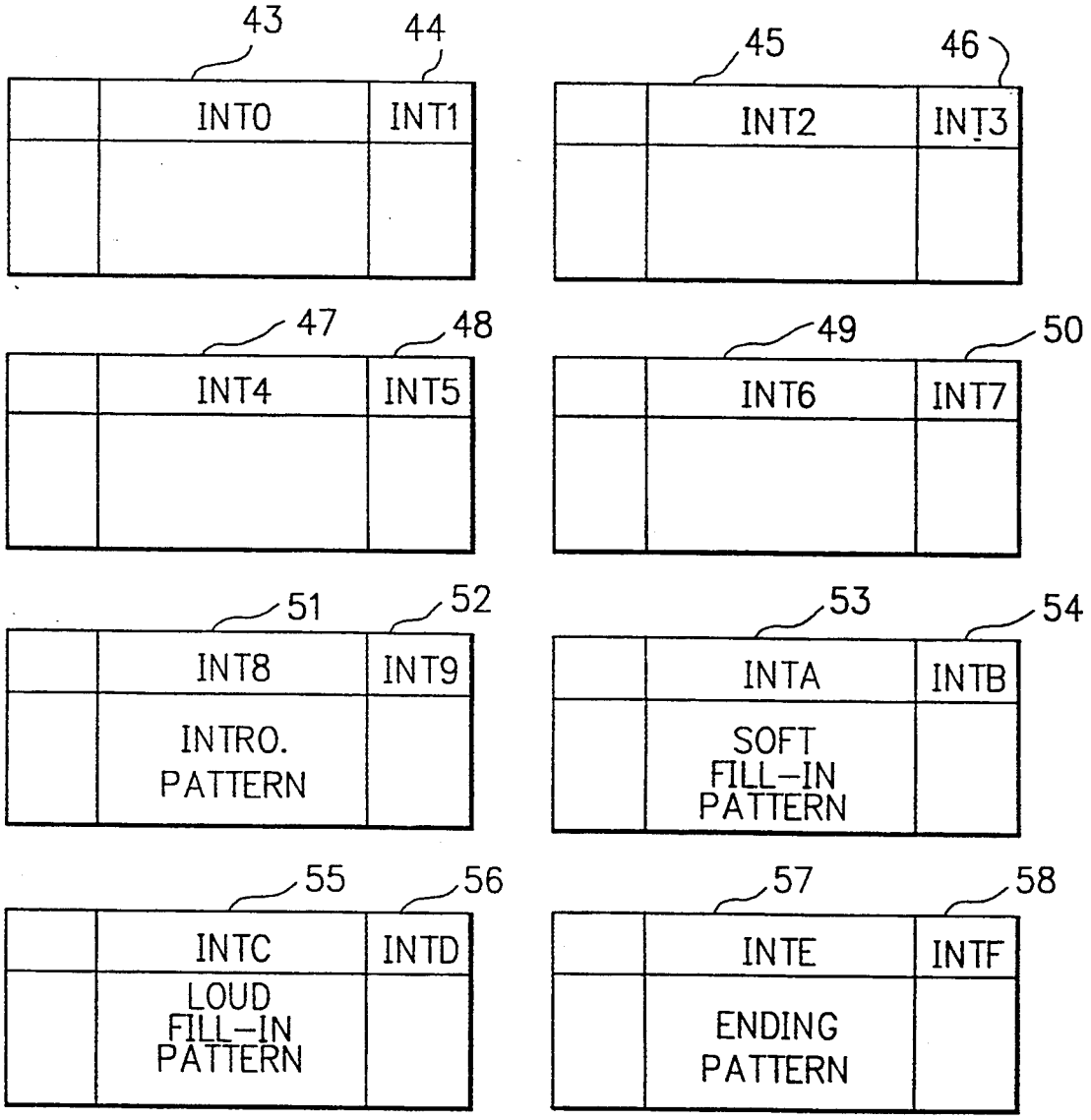
FIG. 8 shows data formats of intonation pattern data.

FIG. 8 shows an arrangement of intonation pattern data in one rhythm. 16 intonation pattern data 43 to 58 are arranged in the order of intonation values INT0 to INTF (F=15) corresponding to intonation levels. The intonation pattern data 43 to 50 having the intonation values INT0 to INT7 are used in intonation control. The intonation pattern data 51 to 58 having the intonation values INT8 to INTF are used as a sub-phrase pattern consisting of an introduction pattern (51, 52), a soft fill-in pattern (53, 54), a loud fill-in pattern (55, 56), and an ending pattern (57, 58).

The intonation pattern data 34*a* of one level consists of data for designating a tone volume, a tone color, an instrument, and the like, and play pattern data for obtaining an auto-play pattern for several bars. The play pattern data consists of an array of addresses for reading out auto.-play data (note data) in the ROM 20.

The tone control unit 35 reads out auto-play data from an auto-accompaniment data memory 36 on the basis of the play pattern data in the intonation pattern data, modifies the auto-play data with data for designating a tone volume, a tone color, an instrument, and the like, and outputs the modified data to a tone generator 37. The auto-accompaniment data memory 36 is allocated on the ROM 20, and stores note data strings for an auto-accompaniment such as chord tones, bass tones, drum tones, and the like in units of rhythms. Each note data consists of key (interval) number data, tone generation timing data, tone generation duration data, tone volume data, and the like.

The tone generator 37 reads out corresponding PCM sound source waveforms from a waveform ROM 38 on the basis of the note data from the tone control unit 35, and forms tone signals. Thus, auto-accompaniment tones corresponding to the intonation level can be obtained. The intonation level can be desirably changed by the dial operation.

FIGS. 9 and 10 show in detail data formats of intonation pattern data. The intonation pattern data of one level is constituted by five tracks (channels) of data including chord, bass, and drum1 to drum3 data. Each track consists of a tone volume difference value VEL0, tone color/instrument designation data, and play pattern data. Therefore, these data can be changed or designated in units of tracks.

The 1-byte tone volume difference value VEL0 is a value to be added to a tone volume value of each tone of auto-play data. With this difference value, an accent (tone volume level) can be given in units of tones of each track. For example, in the respective tracks of intonation pattern data 43 and 45 of levels "0" and "2" in FIG. 9, the tone volume difference values are "0". The tone volume difference value of drum2 data of intonation pattern data 47 of level "4" in FIG. 10 is 20H (H represents hexadecimal notation). Therefore, at an intonation level "4", the tone volume of the drum2 track is increased. The tone volume difference values of all the tracks of intonation pattern data 46 of level "6" shown in FIG. 10 are 20H, and the tone volumes of respective accompaniment parts are increased by 20H.

2-byte tone color/instrument data is tone color/instrument change instruction information. In chord and bass tracks, a 1-byte tone color parameter is given, and another 1 byte is not used (NC). In FIGS. 9 and 10, at intonation levels "0" and "2", chord and bass tone color parameters are respectively 01H and 40H. At intonation levels "4" and "6", these tone color parameters are respectively changed to 20H and 40H.

In each of the drum1 to drum3 tracks, 2-byte instrument conversion information is given. In general, as for note information of a drum track, scale data (key data) is assigned as instrument information. For example, "C" is assigned to a bass drum, "D" is assigned to a snare drum, and "E" is assigned to a hi-hat. At the intonation level "2" in FIG. 9, data "26H, 28H" is stored in the drum 1 track. This indicates conversion of 26H (closed hi-hat) in note data into 28H (open hi-hat). Therefore, even when identical note data is used, a drum tone of a different instrument can be generated according to the intonation level.

In three tracks of drum channels, different instruments can be assigned. Since an instrument can be changed in units of tracks, there is a large degree of freedom in a change in intonation pattern according to its level. Since each drum track can access common note data, the amount of note data can be prevented from being greatly increased even if the number of drum channels is increased.

The play pattern portion of intonation pattern data consists of four bars of note indication information. The note indication information is address data indicating a specific position of note data. One bar consists of four beats, and for example, 1.0 and 1.2 respectively represent the first and third beats of one bar. For example, in a chord track of the intonation level "0", the playback operation of notes for four beats of the first bar progresses from address 0000H, and in the second bar, the playback operation of notes progresses from address 0001H. At the end of the fourth bar, a repeat mark REP is recorded. When the playback operation progresses to this symbol, it returns to the top address.

When note indication information in the play pattern portion is changed, a play pattern can be easily changed. For example, at the intonation level "0", 0100H and 1010H are given as indication information of the bass track. However, at level "2", these pieces of information are changed to 0102H and 0103H. Therefore, at level "2", the instrument of drum1 is changed, and the play pattern of a bass line is changed. In this manner, when the play pattern portion is partially changed, a different intonation level can be easily obtained.

At the intonation level "4", the tone color in the chord track, instruments in the drum1 and drum2 tracks, and the tone volume in the drum2 track are changed without changing the play pattern of the level "2". At the level "6", at least one of the tone volume, tone color, instrument, and play pattern of each track is changed. The level "6" indicates a considerable degree of tone-up of a performance.

As shown in FIG. 8, pattern data shown in FIGS. 9 and 10 are used for the even-numbered levels "0", "2", "4", and "6", and only tone volume difference data are used as pattern data for the odd-numbered levels "1", "3", "5", and "7". At the odd-numbered levels, the same tone color/instrument data and play pattern data as those at the immediately preceding levels are used, and are omitted. Therefore, at the odd-numbered levels, only the tone volume is changed, and an accent is added to an accompaniment. In this manner, the entire data amount of intonation pattern data for eight levels can be compressed to about half. When intonation pattern data at an odd-numbered level is to be developed, tone color-/instrument data and play pattern data are read from the immediately preceding level, and an addition is performed for only the tone volume.

The sub-phrase patterns at .levels 8 to F may have the same data formats as intonation pattern data shown in FIGS. 9 and 10. Patterns at odd-numbered levels 9, B(11), D(13), and F(15) are reduced patterns consisting of only tone volume difference data.

Figure 11:
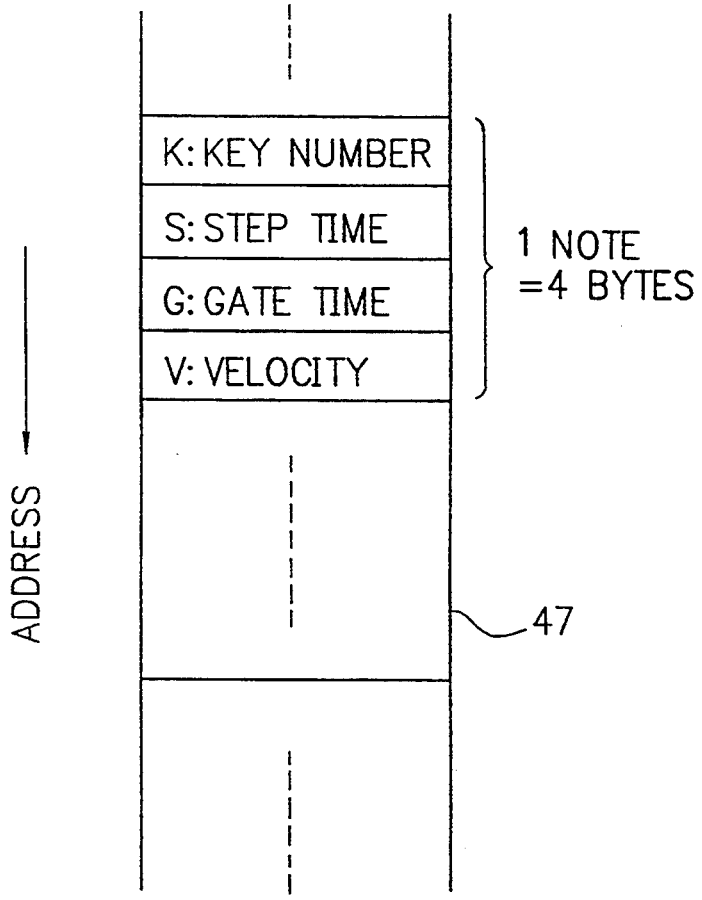
FIG. 11 shows a format of note data read out according to intonation pattern data.

FIG. 11 partially shows note data 47 accessed through intonation pattern data or sub-phrase pattern data. One note of note data consists of four bytes, i.e., a key number K, a step time S, a gate time G, and a velocity V. The key number K indicates a scale, the step time S indicates a tone generation timing, the gate time G indicates a tone generation duration, and the velocity V indicates a tone volume (key depression pressure) of a tone. Although not shown, note data also includes tone color data, a repeat mark of a note pattern, and the like.

The note data is sequentially read out in units of four bytes each from an address designated by the play pattern portion of the intonation pattern data from the auto-accompaniment data memory 36. The tone control unit 35 shown in FIG. 5 performs address control on the basis of intonation pattern data, modifies the tone volume and key number of the readout note data with tone volume and instrument instruction data of the intonation pattern data, or changes the tone color, and outputs the modified data to the tone generator 37.

Figure 12:
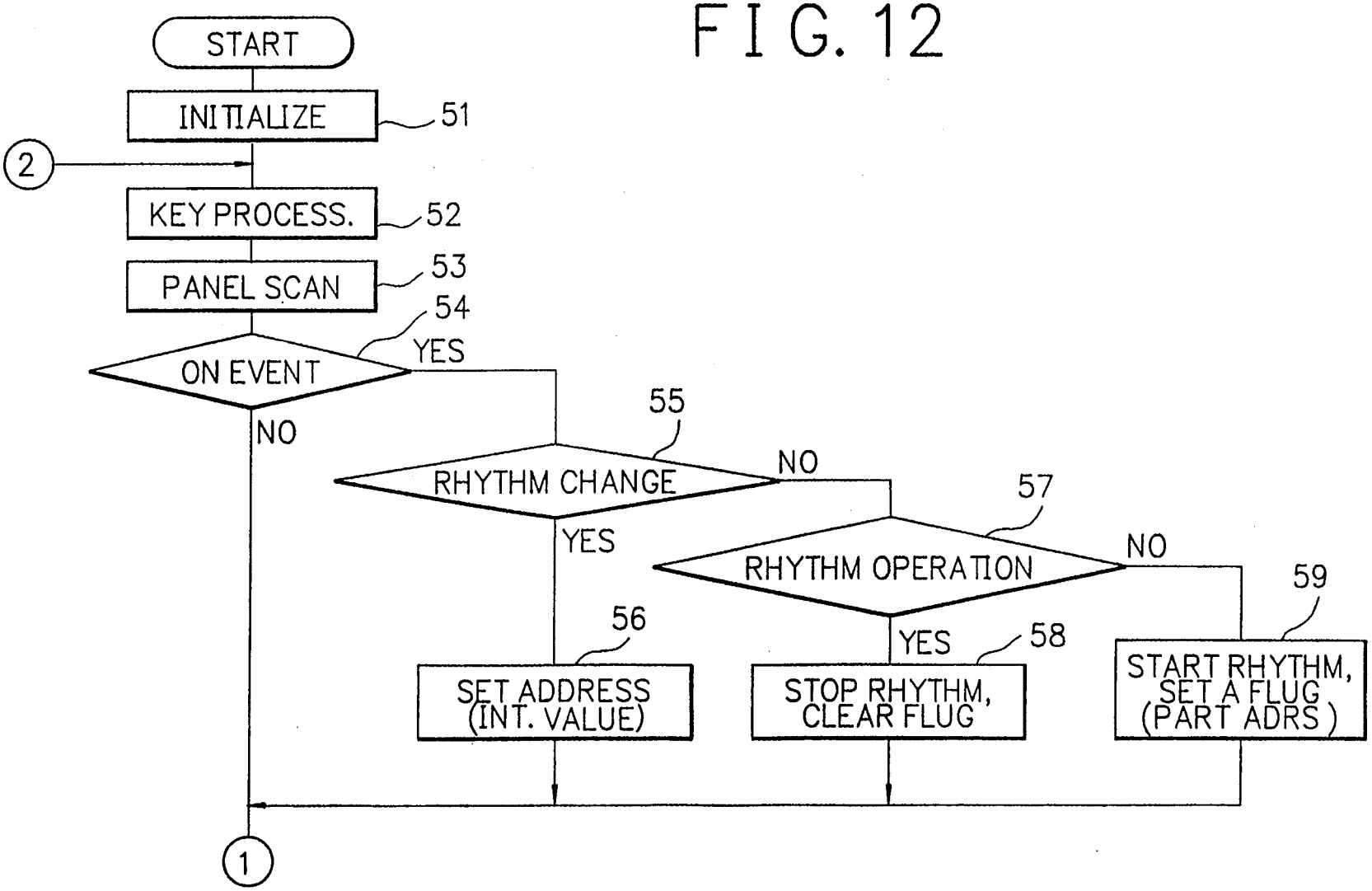
FIGS. 12 to 20 are flow charts showing auto-play control using intonation pattern data.
Figure 13:
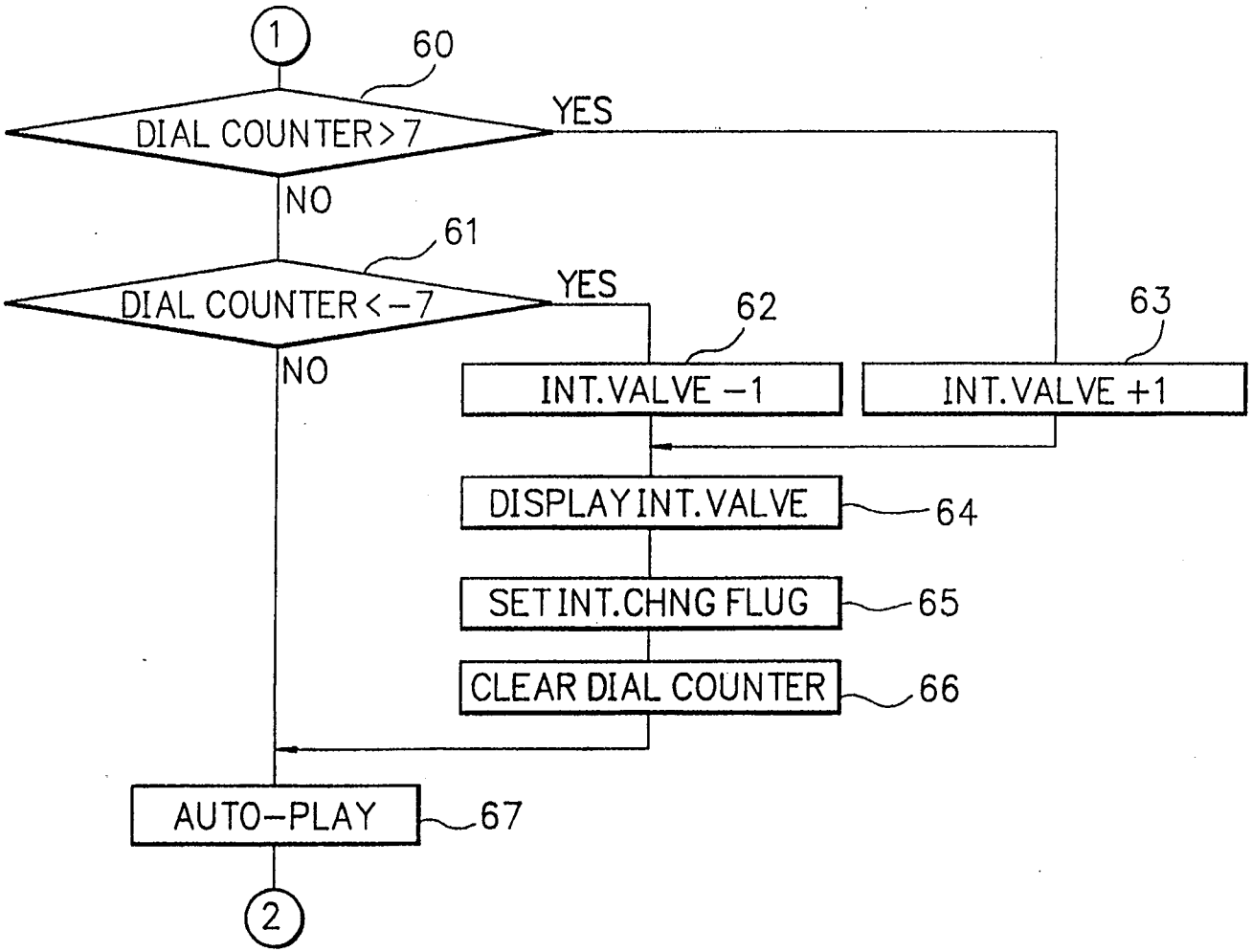

FIGS. 12 to 18 are flow charts showing auto-play control using intonation pattern data. FIGS. 12 and 13 show the overall flow. In step 51, initialization is performed. In step 52, processing corresponding to an operation at the keyboard 11 is performed. In step 53, panel scan (operation detection) processing is performed. If an ON event is detected, the flow advances from step 54 to step 55 to check if a rhythm is changed. When a rhythm is designated by using the ten-key switches 12*a* on the operation panel 12, an address for reading out intonation pattern data corresponding to the designated rhythm is set in step 56. More specifically, the top address of the intonation pattern data 42 shown in FIG. 7 is set using the intonation preset value (FIG. 6) corresponding to the designated rhythm.

If NO in step 55, since the rhythm start/stop button 12*b* on the panel 12 is operated, it is checked in step 57 if a rhythm operation is being performed. If YES in step 57, the rhythm is stopped, and a flag is cleared (step 58); otherwise, the rhythm is started, and the flag is set (step 59). In step 59, the note read addresses of the respective accompaniment parts are set.

If it is determined in step 54 that an ON event is not detected, the control advances to dial processing shown in FIG. 13. In this dial processing, an intonation value is changed in response to an operation of the dial 2. In steps 60 and 61, it is checked if a count value of output pulses from the pulse generator 14 is equal to or larger than 7 and is equal to or smaller than $-7$. If YES in step 60, the intonation value is incremented by $+1$ (step 63). If YES in step 61, the intonation value is decremented by $-1$ (step 62). Note that about a $\frac{1}{3}$ revolution of the dial 2 corresponds to the count value "7". When the dial 2 is turned clockwise, the count value is increased; when it is turned counterclockwise, the count value is decreased.

In step 64, the intonation value is displayed on the display 13. In step 65, an intonation change flag is set. In step 66, a dial counter is cleared. An auto-play routine (step 67) is then executed, and the control loops from step 52 in the key processing shown in FIG. 12.

Figure 14:
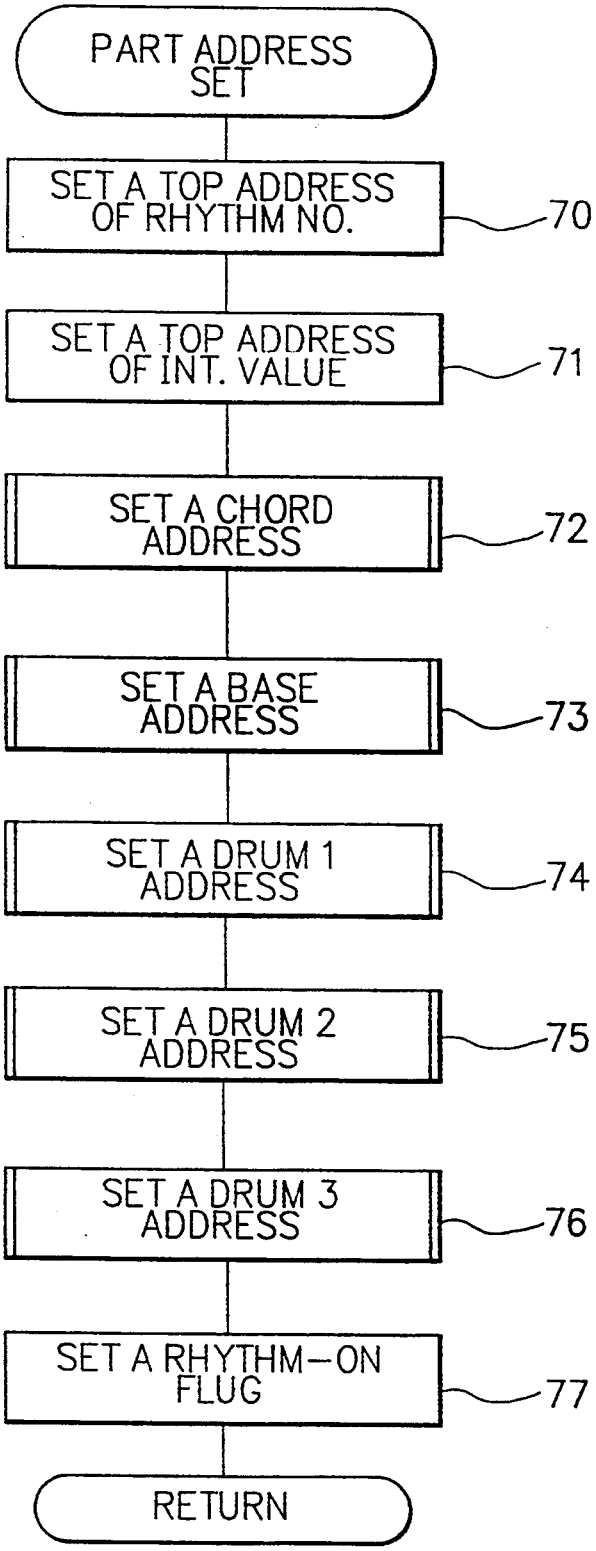

FIG. 14 shows in detail the part address set routine shown in FIG. 12. In step 70, the top address of intonation pattern data corresponding to a rhythm number is set. In step 71, the top address of intonation pattern data indicated by the current intonation value is set. Furthermore, in steps 72 to 76, read addresses of intonation pattern data for five tracks, i.e., chord, bass, and drum1 to drum3 tracks, are set. The corresponding data are read out to a buffer. In step 77, a rhythm ON flag is set.

Figure 15:
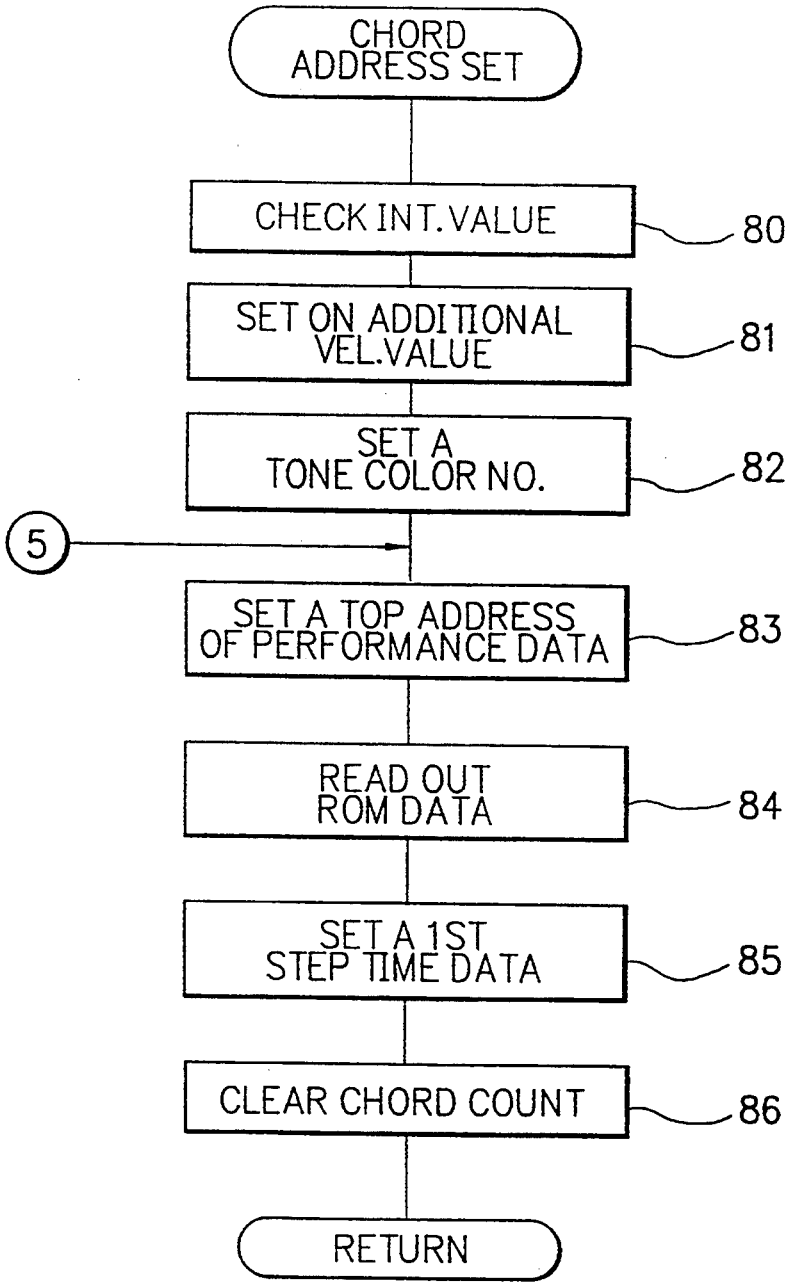

FIG. 15 shows in detail the chord address set routine shown in FIG. 12. In step 80, the intonation value is checked. In step 81, tone volume difference data of the intonation pattern data is set as an additional velocity value. In step 82, a tone color number is set. In step 83, the top address of play pattern data is set. In step 84, note data for one tone corresponding to the top address of the auto-play data is read out from the ROM 20. In step 85, the first step time data is set in a buffer. In step 86, a counter value of a time base counter of note data of the chord track is cleared, and the flow returns to the main routine. Steps 73 to 76 for other channels in FIG. 12 are executed in the same manner as described above.

Figure 16:
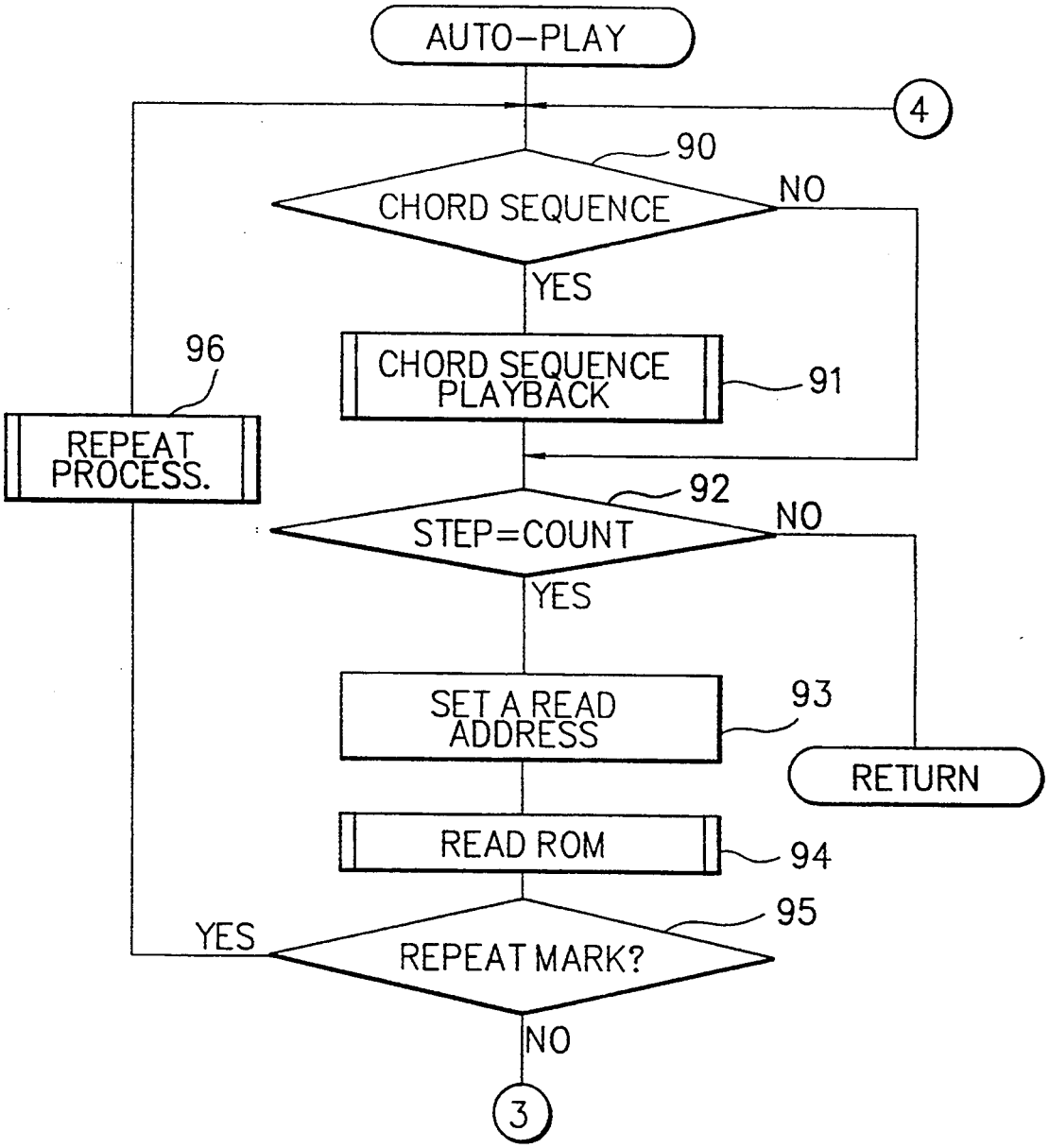
Figure 17:
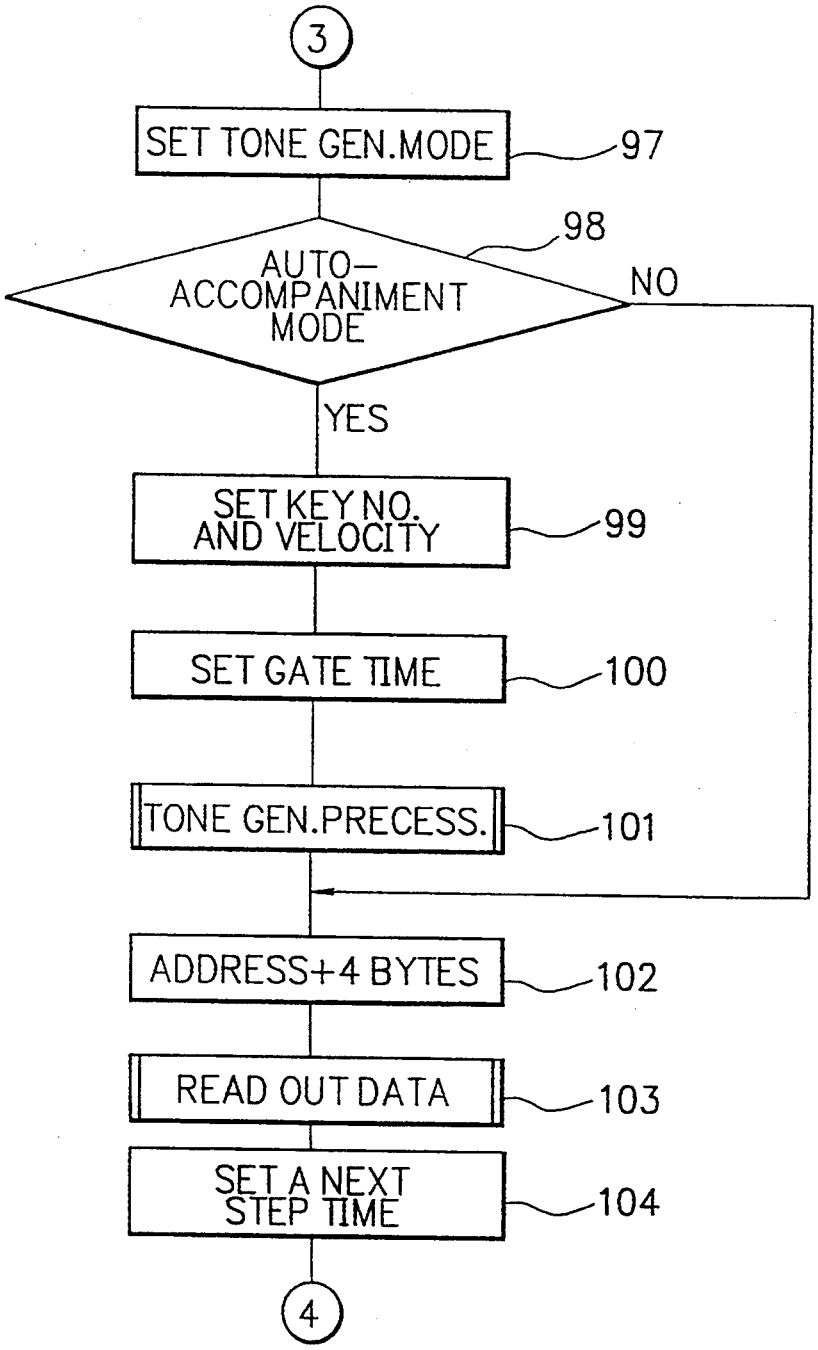

FIGS. 16 and 17 show in detail the auto-play routine executed in step 67 in FIG. 13. In this routine, in step 90, it is checked if a chord sequence mode is set. If YES in step 90, a chord sequence pattern is played back in step 91 to develop the scale of the chord. In step 92, it is checked if the count value of the time base counter coincides with the step time in the buffer. If NO in step 92, the flow returns to the main routine.

If it is determined in step 92 that the count value of the time base counter coincides with the step time, a read address is set (step 93), and 4-byte data is read out from the ROM 20. In step 95, it is checked if the readout note data is a repeat mark. If YES in step 95, repeat processing is executed in step 96, and the flow returns to a node before step 90. If it is determined in step 95 that the readout note data is normal note data, the flow advances to step 97 in FIG. 17, and a tone generation mode is set.

It is then checked in step 98 if an auto-accompaniment mode is set. If YES in step 98, a key number, a velocity value, and a gate time are respectively set in steps 99 and 100, and tone generation processing of a corresponding note is performed in step 101. Upon completion of the tone generation processing, the read address is advanced by four bytes in step 102, and note data to be generated next is read out from the ROM 20 in step 103. The next step time is set in the buffer, and the control then returns to the beginning of the auto-play routine shown in FIG. 16. This processing is repeated to sequentially generate auto-accompaniment tones.

Figure 18:
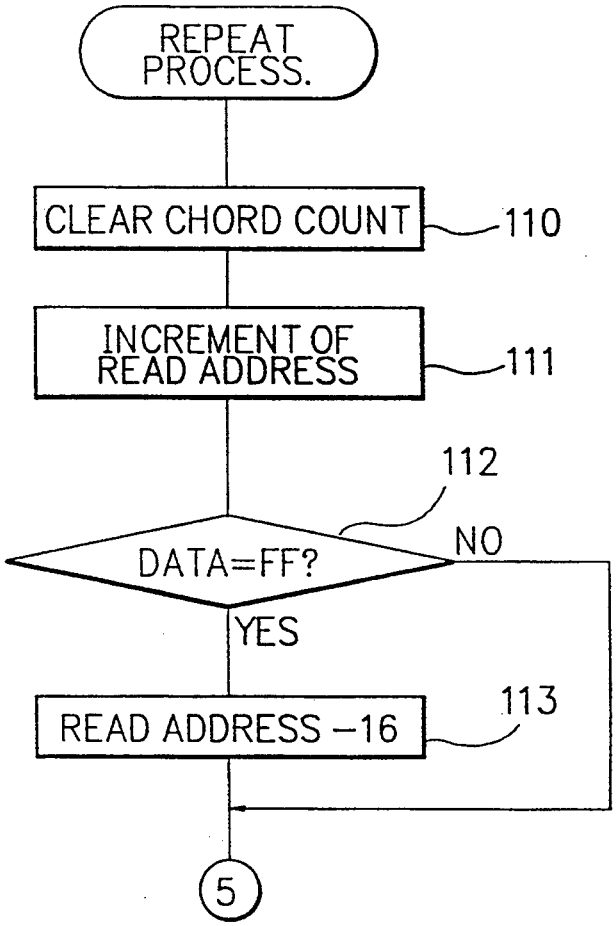

If it is determined in step 95 in FIG. 16 that the repeat mark at the end of note data is detected, the flow advances to step 96, and repeat processing shown in FIG. 18 is executed. In this routine, a chord count of the time base counter is cleared in step 110, and the read address of intonation pattern data is incremented by one in step 111. It is then checked in step 112 if the current auto-play pattern data is the repeat mark REP(FFH) shown in FIGS. 9 and 10. If NO in step 112, the flow returns to step 83 in FIG. 15. In step 83, the top address of an auto-play pattern of the next bar, i.e., the second bar is set to continue a read operation of note data.

If it is determined in step 112 in FIG. 18 that the repeat mark REP(FFH) is detected, 16 is subtracted from the read address of the intonation pattern data in step 113 to return the read position to the first beat of the first bar so as to continue the read operation of note data from step 83 in FIG. 15.

The intonation levels of accompaniment tones can be desirably changed by operating the dial 2. When the arrangement order of the levels of intonation pattern data is caused to coincide with the degree of tone-up of a performance, the dial operation feeling for gradually intensifying accompaniment tones can be obtained. In place of the dial, a foot pedal may be used. Alternatively, a pair of push buttons capable of increasing/decreasing an intonation value may be used.

As described above, the auto-play apparatus of the present invention stores a plurality of levels of intonation patterns corresponding to the degree of tone-up of a performance, variably controls intonation values corresponding to the levels, and controls one or some of a play pattern, tone volume, tone color, and instrument of auto-play data on the basis of intonation pattern data corresponding to the set intonation values. Therefore, according to the present invention, an auto-play mode can be desirably controlled by controlling the intonation levels. When intonation patterns of the respective levels are set in advance to be gradually changed in correspondence with the degree of tone-up of a performance, an auto-play operation of auto-accompaniment tones can be gradually enhanced by a stepwise change in intonation level.

Figure 19:
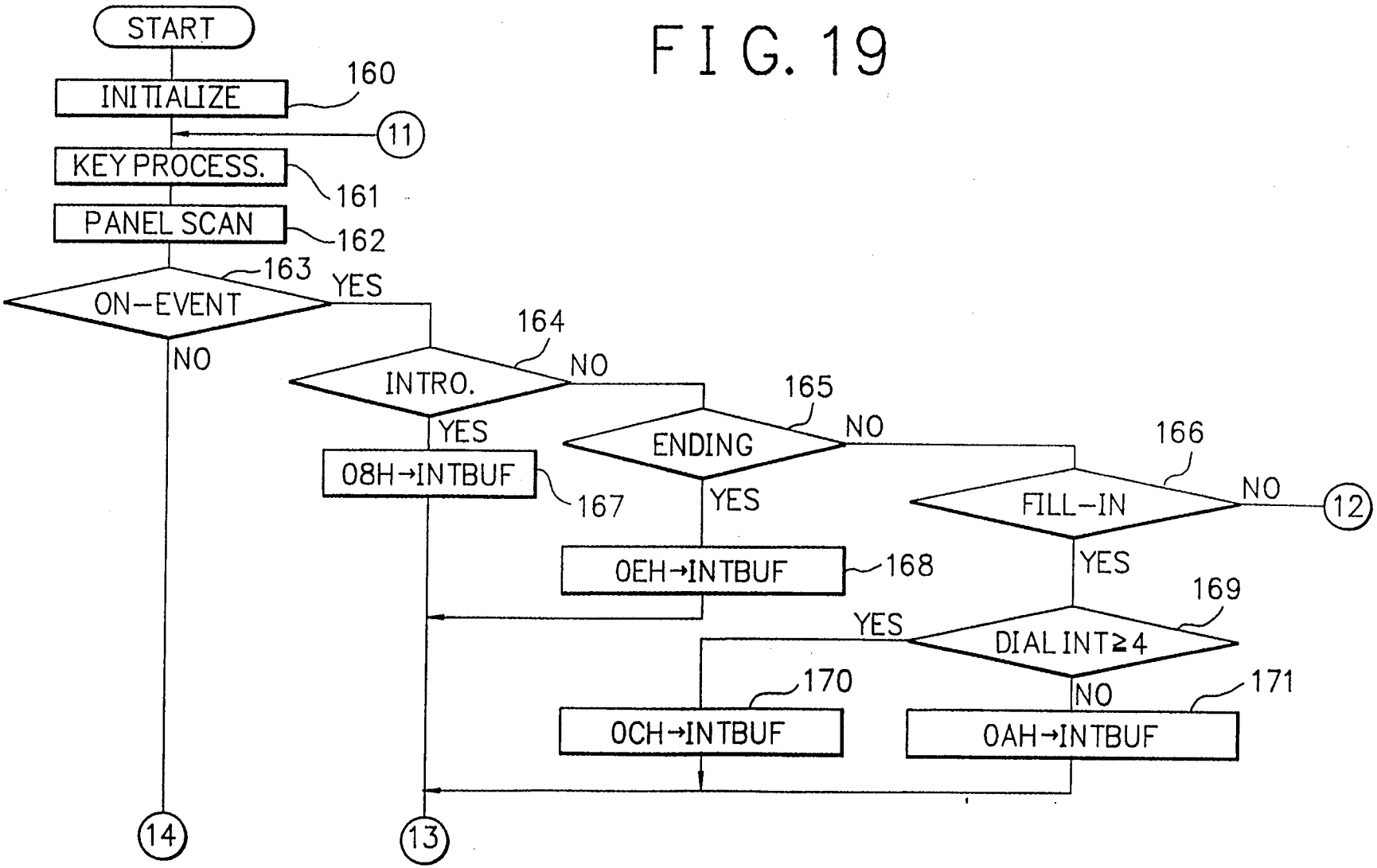
Figure 20:
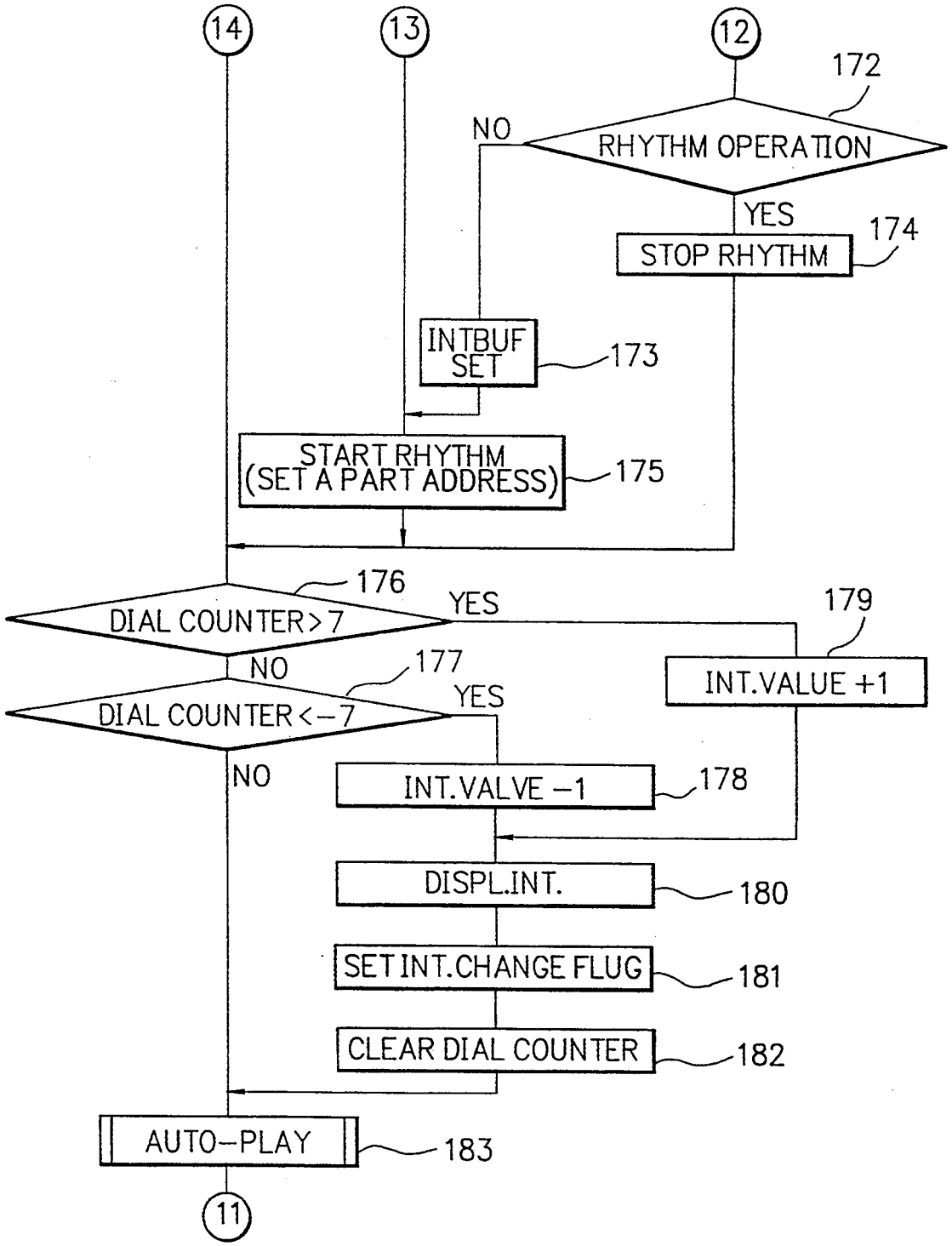

FIGS. 19 and 20 are flow charts showing auto-play control using the sub-phrase patterns of levels 8 to F. In step 160 in FIG. 19, initialization is performed. In step 161, processing for operations at the keyboard 11 is executed. In step 162, panel scan (operation detection) processing is executed. If an ON event is detected, it is checked in steps 164 to 166 if the ON event corresponds to an operation of one of the push-button switches **12*b*** for inserting introduction, ending, and fill-in sub-phrases during a performance.

If it is determined that the button corresponding to the introduction sub-phrase is operated, a value "08H" is stored in an intonation buffer INTBUF as an intonation value in step 167. If it is determined that the button corresponding to the ending sub-phrase is operated, a value "0EH" is stored in the intonation buffer INTBUF as the intonation value in step 168. If it is determined that the button corresponding to the fill-in sub-phrase is operated, it is checked in step 169 if the intonation value set by the dial is equal to or larger than 4. If YES in step 169, a value "0CH" is stored in the intonation buffer INTBUF as the intonation value in step 170. However, if NO in step 169, a value "0AH" is stored in the intonation buffer INTBUF as the intonation value in step 171. These intonation substitution values correspond to intonation values of the sub-phrase patterns shown in FIG. 8. Upon completion of the substitution processing of the intonation value, the flow advances to rhythm start step 175 in FIG. 20.

If NO is determined in one of steps 164 to 166, since this means that a rhythm start/stop operation is performed, the flow advances from step 166 to step 172 in FIG. 20 to check if a rhythm operation is being performed. If YES in step 172, the intonation value at that time is set in the buffer in step 173, and the flow then advances to rhythm start step 175. In step 175, note read addresses of respective accompaniment parts (tracks) are set. If it is determined in step 172 that a rhythm operation is not performed, the rhythm is stopped, and the control enters dial count processing.

In the dial count processing shown in FIG. 20, the intonation value is changed in response to the operation of the dial 2. It is checked in steps 176 and 177 if the count value of output pulses from the pulse generator 14 is equal to or larger than 7 and is equal to or smaller than −7. If YES in step 176, the intonation value is incremented by +1 (step 178). If YES in step 177, the intonation value is decremented by −1 (step 179). Note that about a $\frac{1}{3}$ revolution of the dial 2 corresponds to the count value "7". When the dial 2 is turned clockwise, the count value is increased; when it is turned counter-clockwise, the count value is decreased.

In step 180, the intonation value is displayed on the display 13. In step 181, the intonation change flag is set. In step 182, the dial counter is cleared. An auto-play routine (step 183) is then executed, and the control loops from step 161 in the key processing shown in FIG. 19.

As described above, when the introduction selection switch is depressed, the intonation value is set to be 08H, and an auto-play operation of the sub-phrase pattern is performed based on the introduction pattern 51. When the ending selection switch is depressed, the intonation value is set to be 0EH, and an auto-play operation of the sub-phrase pattern is performed based on the ending pattern 57. When the fill-in selection switch is depressed, if the intonation value at that time is smaller than 4, the intonation value is set to be 0AH, and an auto-play operation of the sub-phrase pattern is performed based on the soft fill-in pattern 53 having a relatively low degree of tone-up. If the intonation value at that time is equal to or larger than 4, the intonation value is set to be 0CH, and an auto-play operation of the sub-phrase pattern is performed based on the loud fill-in pattern 55 having a relatively high degree of tone-up.

As described above, the auto-play apparatus of the present invention comprises an intonation value varying means for increasing/decreasing an intonation value in correspondence with the degree of tone-up of a performance, and a play pattern storage means for storing a plurality of play patterns of short phrases having different degrees of tone-up. When an insertion instruction of a short phrase is issued, one of the plurality of play patterns is selected according to the magnitude of the intonation value, and a corresponding note data string is read out from a note data storage means on the basis of the selected play pattern, thereby performing an auto-play operation. Therefore, according to the present invention, the play pattern of the short phrase inserted upon an instruction operation is automatically changed in correspondence with the degree of tone-up of a performance. Thus, even when the play pattern of the short phrase is inserted, the tone-up of the performance can be prevented from being spoiled.

Figure 21:
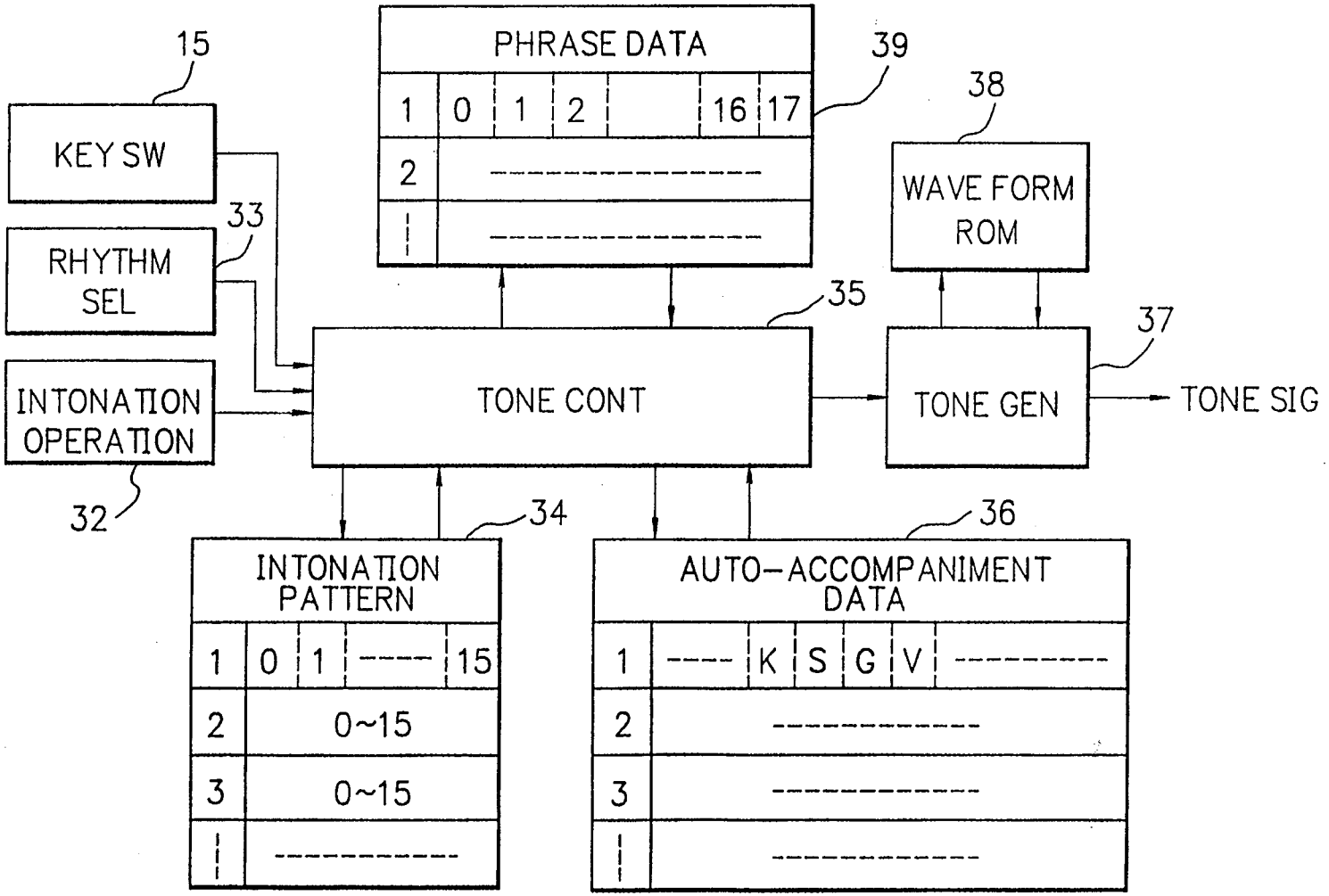
FIG. 21 is a block diagram showing the second embodiment of an auto-play apparatus according to the present invention.

FIG. 21 is a block diagram showing the second embodiment of the present invention. An intonation operation unit 32 corresponds to the dial 2 and the pulse generator 14 shown in FIG. 4. A rhythm selection unit 33 is constituted by ten-key switches 12*a* arranged on the operation panel 12. The operation panel 12 is also provided with selection buttons 12*b* for selecting a rhythm accompaniment mode, an automatic chord accompaniment mode, an adlib phrase-play mode, and the like.

When the dial 2 is operated in accordance with the degree of tone-up of a performance, the output pulses from the pulse generator 14 are supplied to a tone control unit 35. A rhythm number selected by the rhythm selection unit 33 is supplied to the tone control unit 35. Operation information input at the keyboard 11 is supplied to the tone control unit 35 through a key switch circuit 15.

Figure 22:
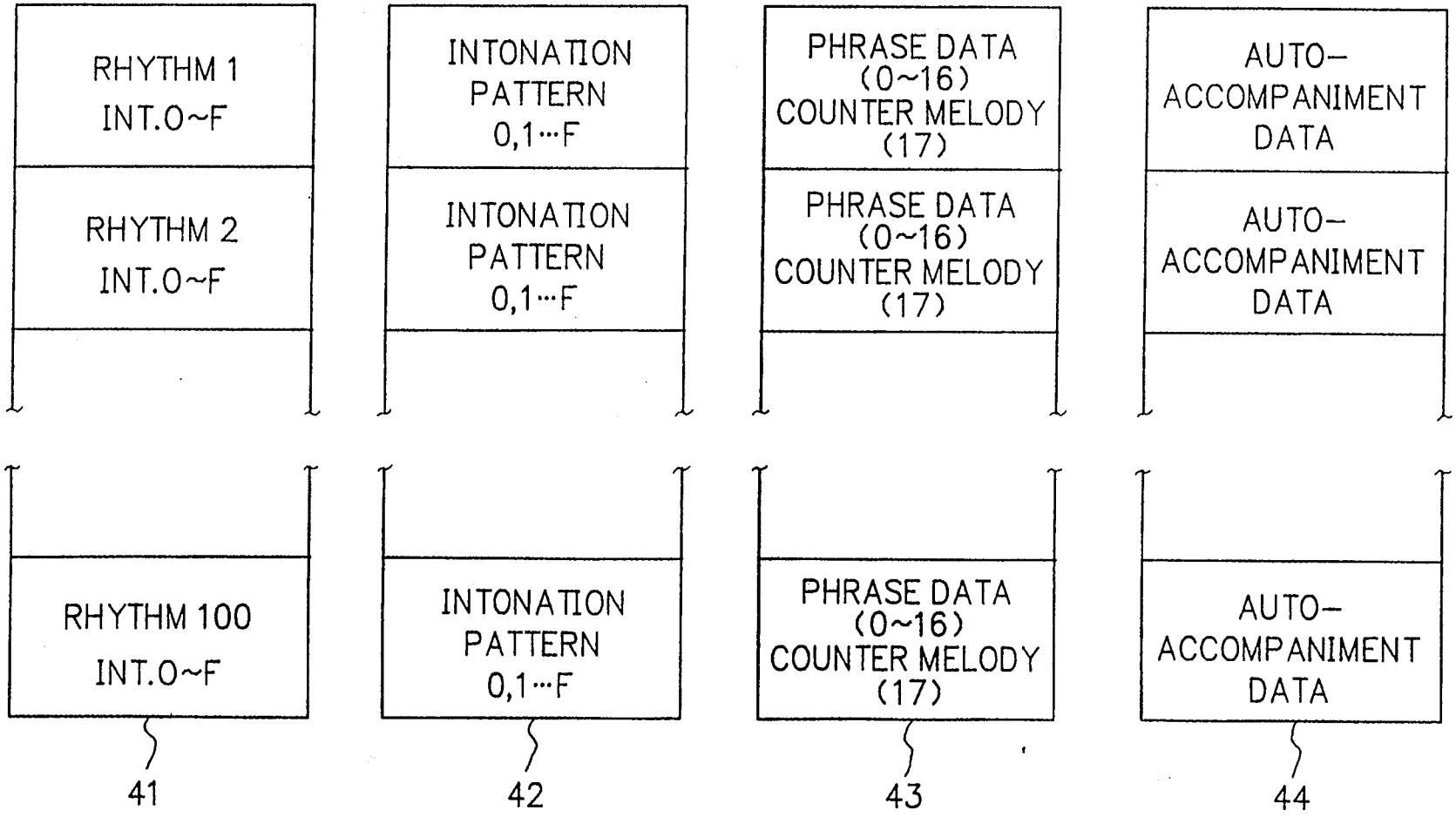
FIG. 22 shows a format of auto-accompaniment data.

An intonation pattern memory 34 connected to the tone control unit 35 is allocated on the ROM 20. As shown in FIG. 22, the memory 34 has an intonation pattern table 42 having a plurality of levels (e.g., 16 levels from 0 to 15) corresponding to intonation values in units of rhythms. Therefore, intonation pattern data 34*a* of a predetermined level corresponding to the selected rhythm and the input intonation value is read out from the memory 34, and the readout data is supplied to the tone control unit 35. For example, if the selected rhythm number is "1", and the intonation value is "2", intonation pattern data 34*a* of corresponding level "2" is read out.

A phrase data memory 39 connected to the tone control unit 35 is allocated on the ROM 20, and has a phrase data table 43 consisting of 17 different phrase data assigned to 17 keys (0 to 16) in units of rhythms, as shown in FIG. 22. Each phrase data is constituted by play pattern data for reading out note data for about one bar from a play data memory. In the adlib phrase-play mode, phrases are assigned to specific 17 keys in correspondence with the selected rhythm. When one key is depressed, corresponding phrase data is read out from the phrase data memory 39, and note data constituting a 4-beat phrase is read out from an auto-accompaniment data memory 36 on the basis of the readout data. The readout note data is then played back. The phrases corresponding to the 17 keys are different from each other. For example, when the keys are operated every four beats, an adlib play operation can be easily attained.

Counter melody data is stored as the 17th data of each rhythm in the phrase data memory 39. The counter melody is automatically played back through a phrase playback track (channel) as a counter track of a melody line under a predetermined condition. Note that the 0th phrase data assigned to the 17 keys may be used as the counter melody data.

The tone control unit 35 reads out auto-play data from the auto-accompaniment data memory 36 on the basis of the play pattern data of the intonation pattern data and the phrase data, modifies the auto-play data with data for designating a tone volume, tone color, instrument, and the like, and outputs the modified data to a tone generator 37. The auto-accompaniment data memory 36 is allocated on the ROM 20, and comprises a table 44 for storing note data strings for chord, bass, and drum auto-accompaniment operations, and the like in units of rhythms, as shown in FIG. 22. Each note data consists of key (interval) number data, tone generation timing data, tone generation duration data, tone volume data, and the like. Note that the ROM 20 comprises a table 41 for storing intonation preset values in units of rhythms, as shown in FIG. 22.

The tone generator 37 reads out corresponding PCM sound source waveforms from a waveform ROM 38 on the basis of note data from the tone control unit 35, and forms tone signals. Thus, auto-accompaniment tones are obtained. The intonation levels of the accompaniment tones can be desirably changed by operating the dial.

Figure 23:
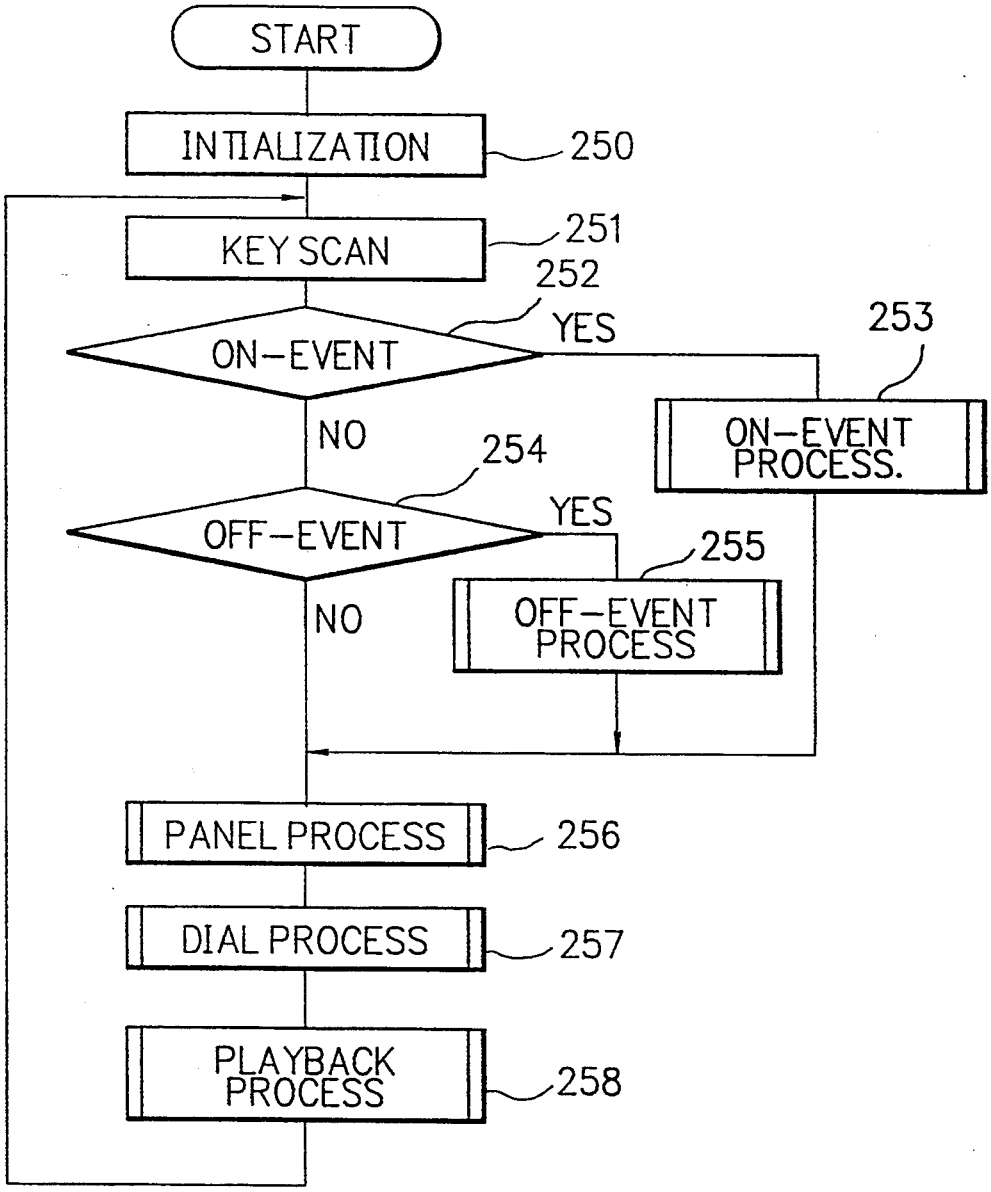
FIGS. 23 to 38 are flow charts showing auto-play control.

FIGS. 23 to 38 are flow charts showing auto-play control using pattern data or phrase data. In step 250 in FIG. 23, initialization is performed. In step 251, scan detection of operations at the keyboard 11 is performed. If a key ON event is detected, the flow advances from step 252 to step 253 to execute ON-event processing. If a key OFF event is detected, the flow advances from step 254 to step 255 to execute OFF-event processing. If no key event is detected, panel operation detection processing is performed in step 256, and intonation dial processing is then executed in step 257. Furthermore, in step 258, tone playback processing is performed. The flow then loops to step 251.

Figure 24:
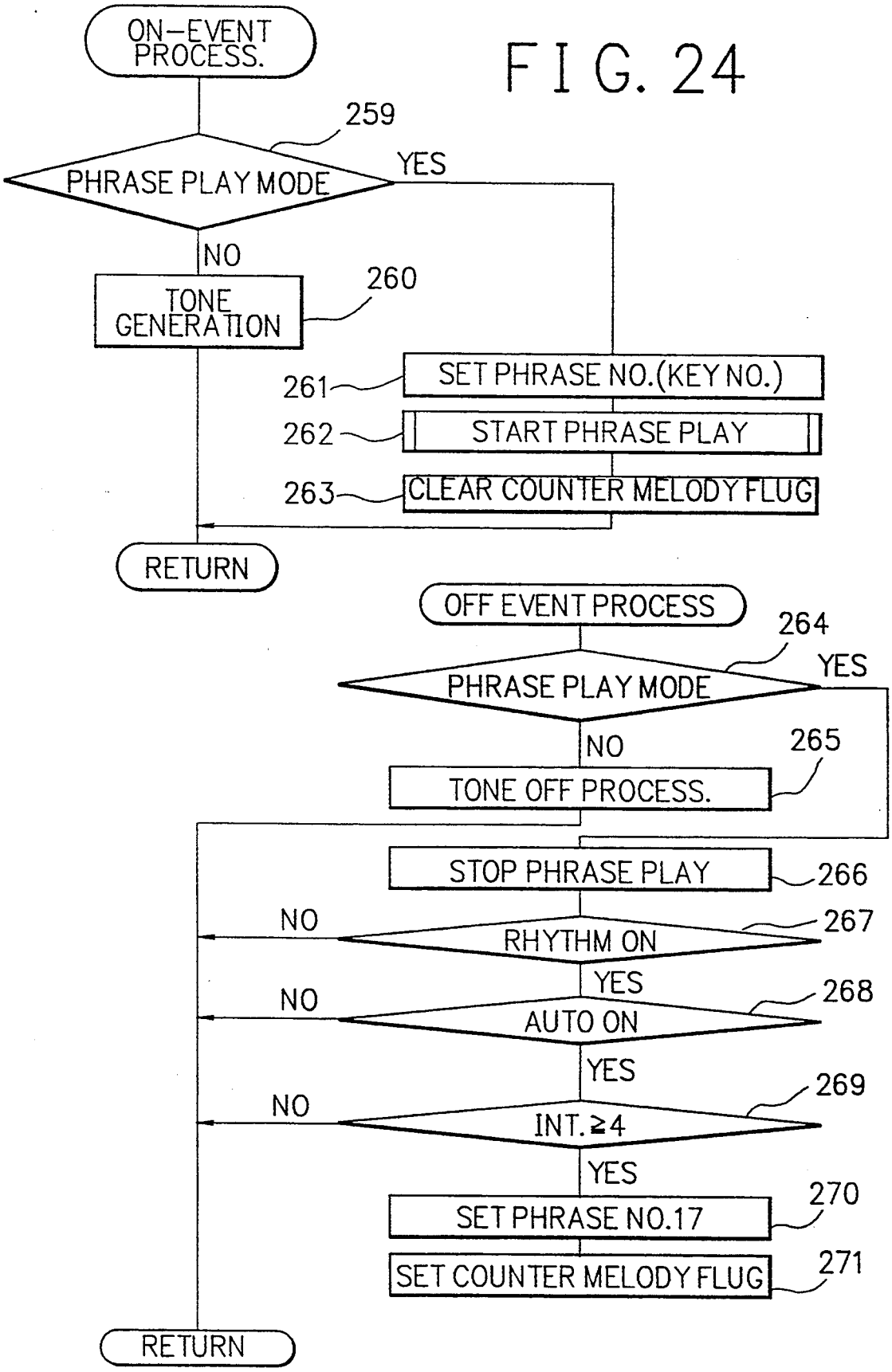

FIG. 24 shows the key ON- and OFF-event processing operations. When an ON event is detected, it is checked in step 259 if a phrase-play mode is set. If NO in step 259, tone generation processing is executed in step 260. However, if YES in step 259, a phrase number (key number) is set in step 261. In step 262, a phrase-play operation is started, and a counter melody flag is cleared in step 263.

In the OFF-event processing shown in FIG. 24, it is checked in step 264 if the phrase-play mode is set. If NO in step 264, tone off processing is performed in step 265. However, if YES in step 264, a phrase-play operation is stopped in step 266. It is then checked in steps 267, 268, and 269 if a rhythm operation is being performed, an auto-accompaniment operation is being performed, and an intonation value is equal to or larger than 4. If these conditions are satisfied, the 17th phrase number is set in step 270, and the counter melody flag is set in step 271. More specifically, when the play tones of the adlib phrase disappear, an auto-play operation is started using the 17th phrase (counter melody). When the intonation value is smaller than 4, since the degree of tone-up of a performance is not so high, a counter melody play operation is not performed.

Figure 25:
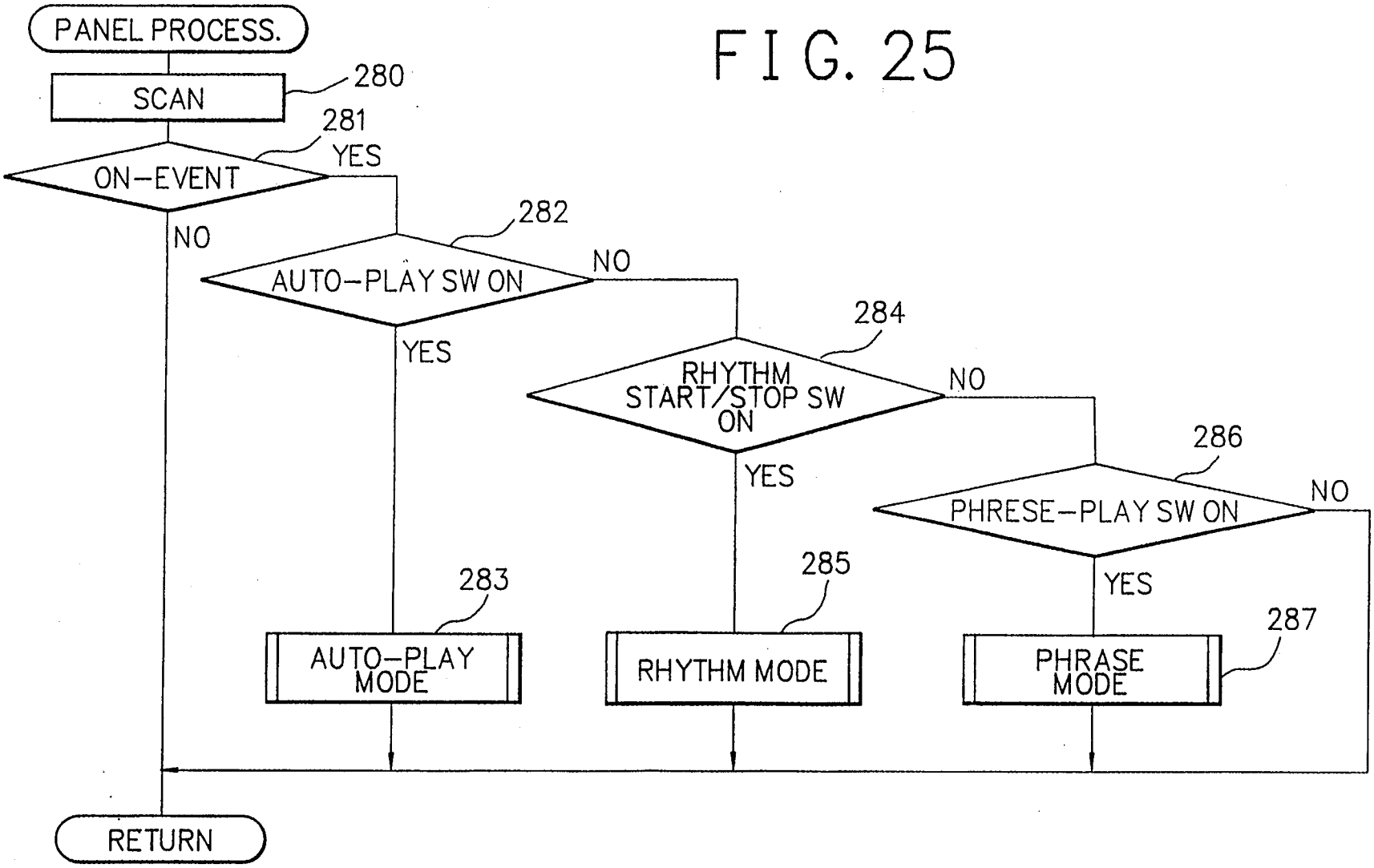

FIG. 25 shows panel processing. In step 280, scan processing is performed. If an ON event is detected, the flow advances from step 281 to switch detection steps 282, 284, and 286. When an auto-play switch of the selection switches 12*a* of the operation panel 12 is turned on, auto-play mode processing is executed in step 283. When a rhythm start/stop switch is turned on, rhythm mode processing is executed in step 285. When a phrase-play switch is turned on, phrase mode processing is executed in step 287.

Figure 26:
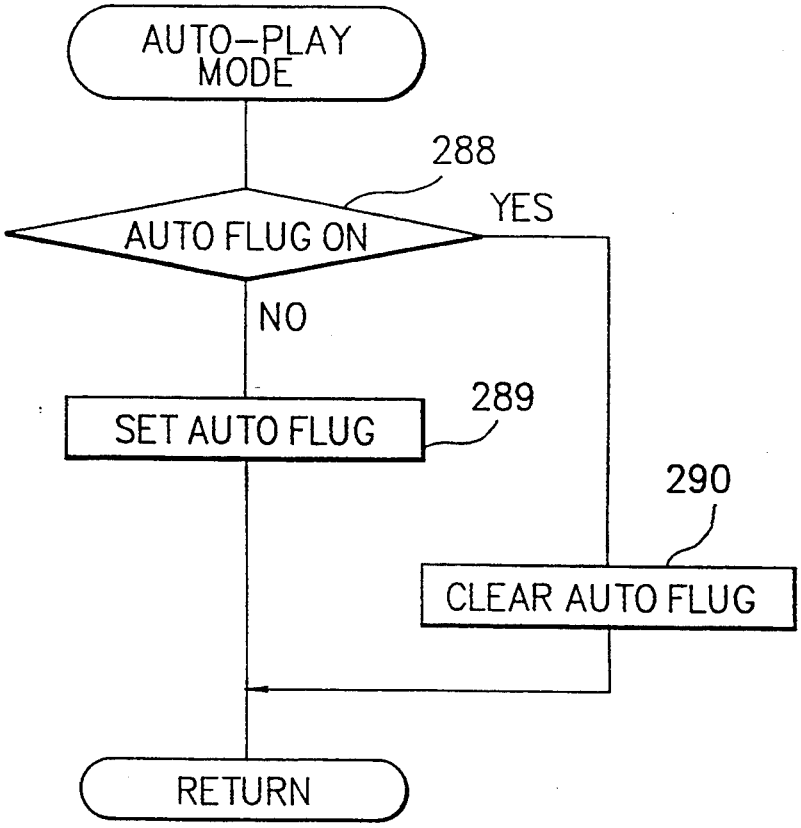

FIG. 26 shows the auto-play mode processing. In this mode processing, it is checked in step 288 if an auto (auto-play) flag is ON. If NO in step 288, the flag is set; otherwise, the flag is cleared.

Figure 27:
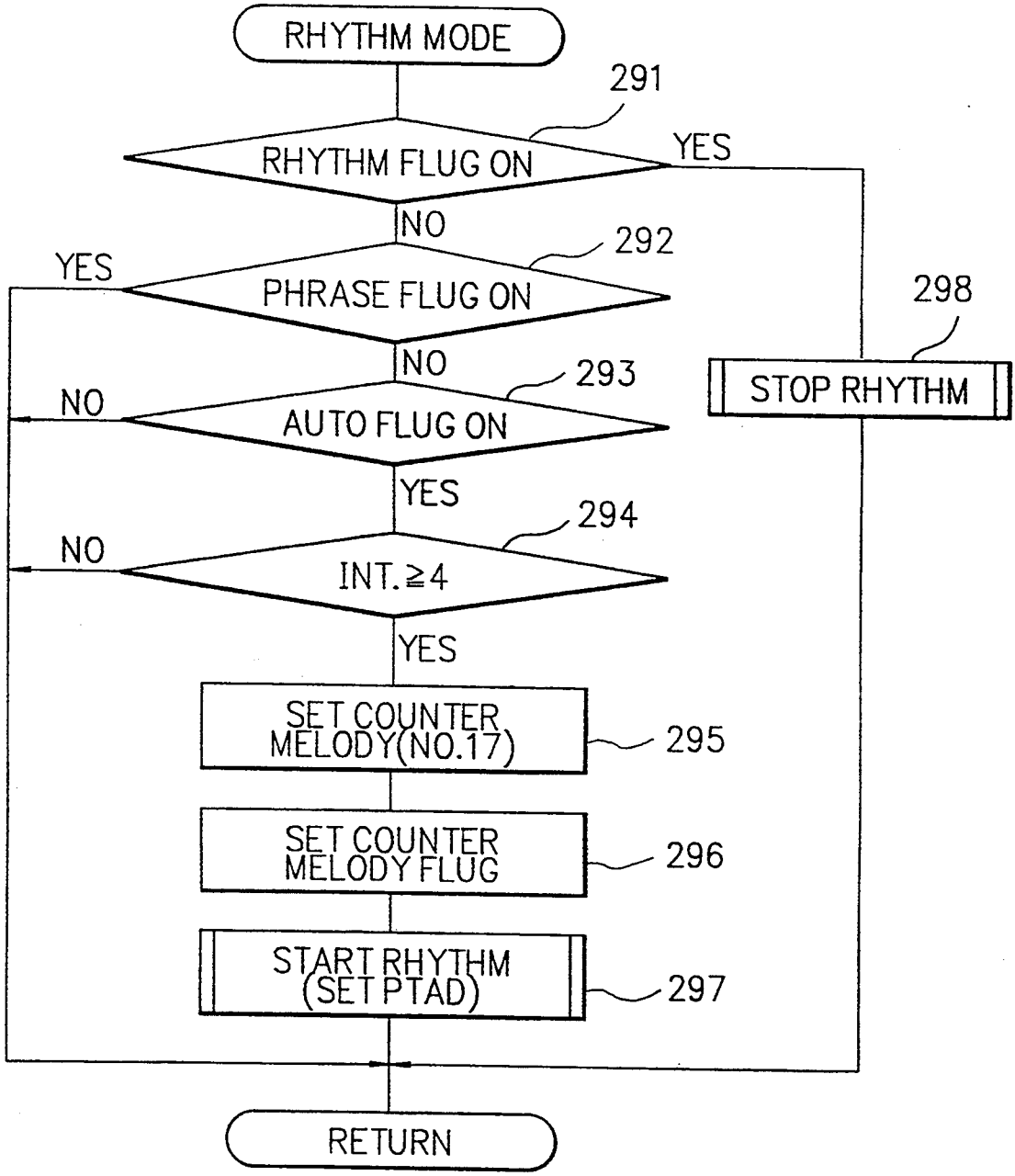

FIG. 27 shows the rhythm mode processing. In this mode processing, it is checked in step 291 if a rhythm flag is ON. If NO in step 291, rhythm start processing is performed in step 297 through steps 292 to 296. In steps 292 to 296, processing for setting the counter melody flag under predetermined conditions is executed. When a phrase-play flag is OFF, if an auto (auto-accompaniment) flag is ON and the intonation value is equal to or larger than 4, the phrase number "17" of a counter melody is set, and the counter melody flag is set. If it is determined in step 291 that the rhythm flag is ON, rhythm stop processing is performed in step 298.

Figure 28:
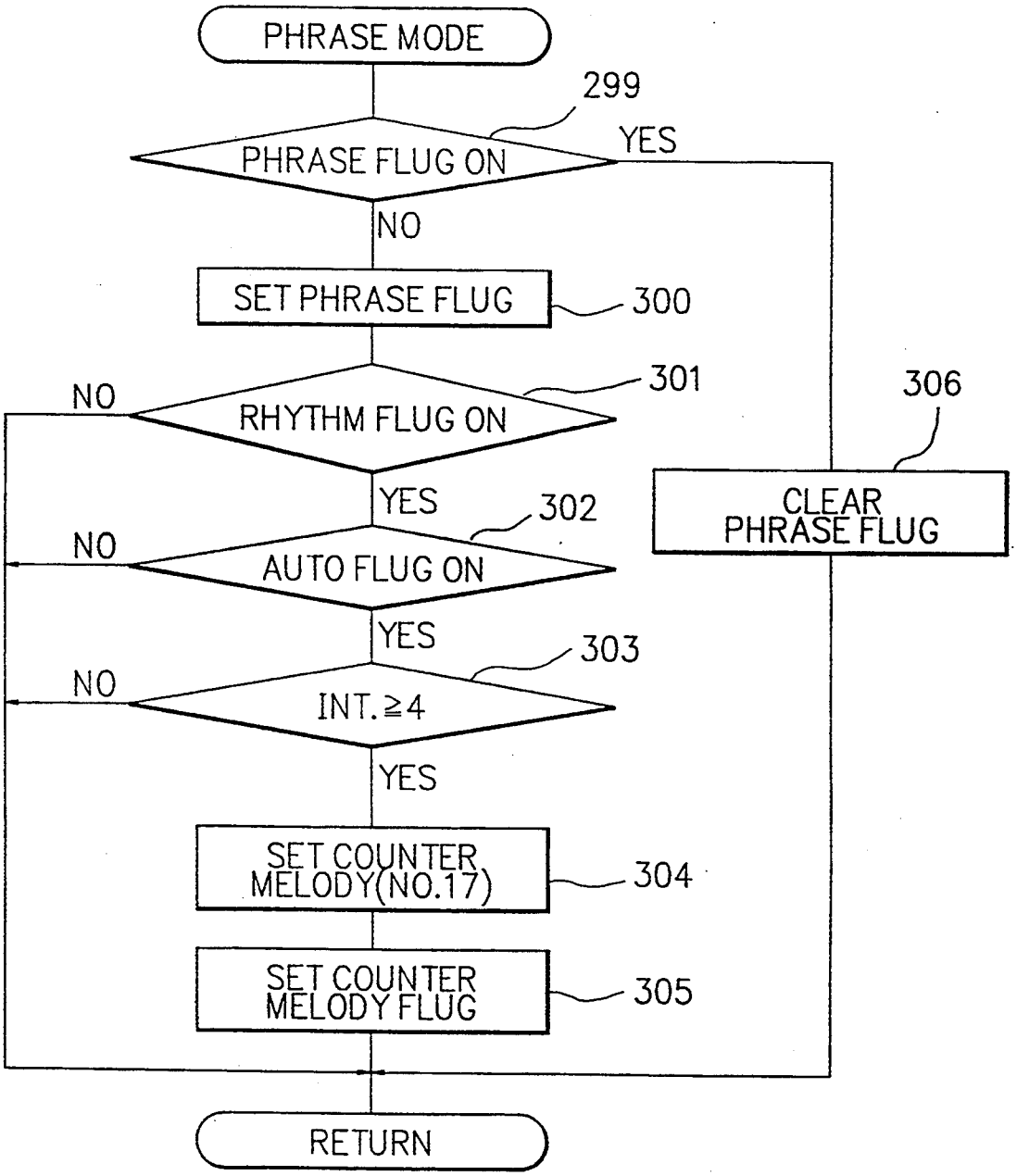

FIG. 28 shows the phrase mode processing. In this mode processing, it is checked in step 299 if a phrase flag is ON. If NO in step 299, the phrase flag is set in step 300, and the counter melody flag is set when the predetermined conditions are satisfied in steps 301 to 305. More specifically, when the rhythm flag is ON, the auto (auto-accompaniment) flag is ON, and the intonation value is equal to or larger than 4, the phrase number "17" of a counter melody is set, and the counter melody flag is set. If it is determined in step 299 that the phrase flag is ON, processing for clearing the phrase flag is executed in step 306.

Figure 29:
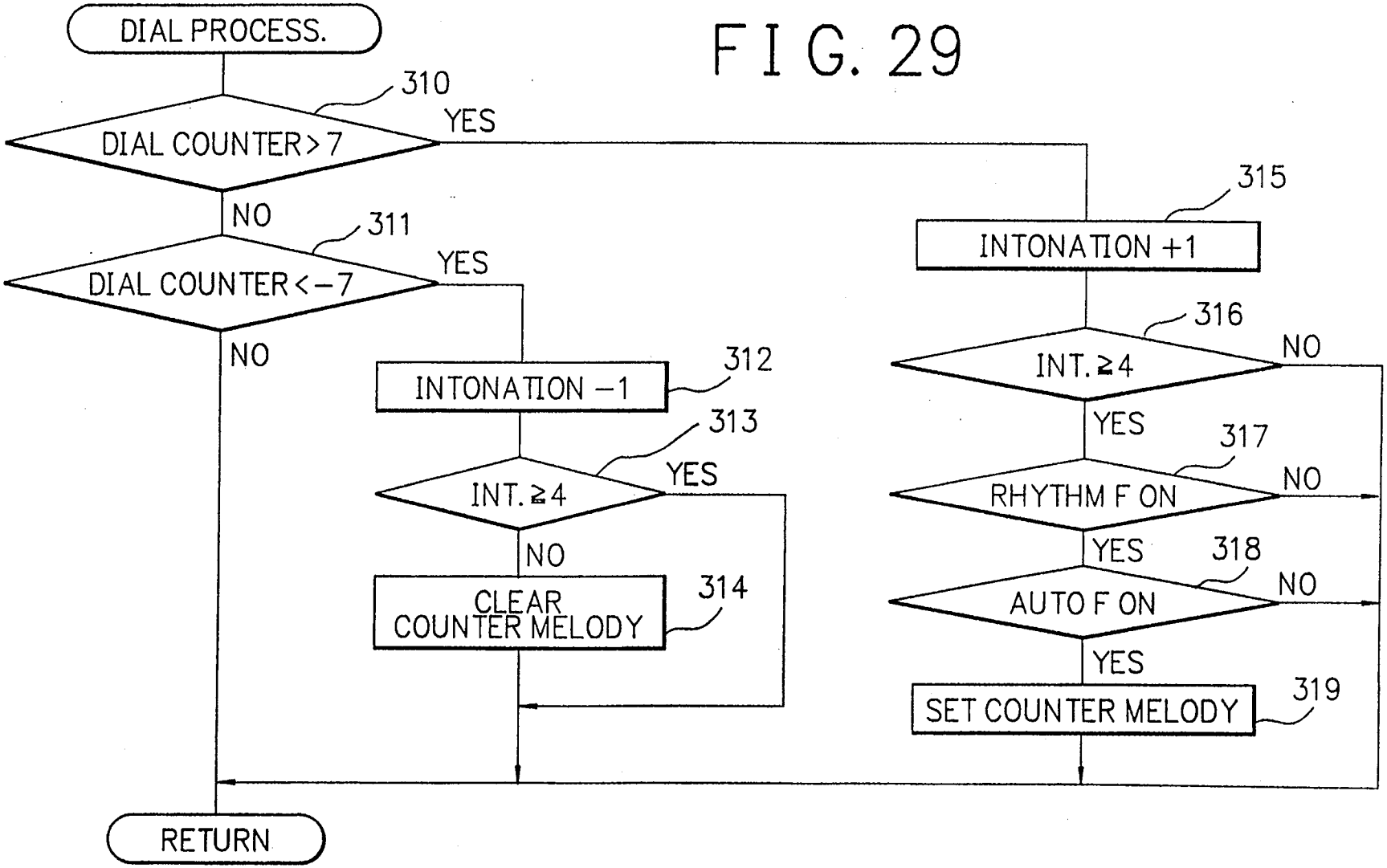

FIG. 29 shows the dial count processing. In this processing, the intonation value is changed in response to an operation of the dial 2. In steps 310 and 311, it is checked if a count value of output pulses from the pulse generator 14 is equal to or larger than 7 and is equal to or smaller than −7. If YES in step 310, the intonation value is incremented by +1 (step 315). If YES in step 311, the intonation value is decremented by −1 (step 312). Note that about a $\frac{1}{3}$ revolution of the dial 2 corresponds to the count value "7". When the dial 2 is turned clockwise, the count value is increased; when it is turned counterclockwise, the count value is decreased.

When the intonation value is incremented by +1, and when predetermined conditions are satisfied in steps 316 to 319, the counter melody flag is set. More specifically, when the rhythm flag is ON, the auto (auto-accompaniment) flag is ON, and the intonation value is equal to or larger than 4, the phrase number "17" of a counter melody is set., and the counter melody flag is set. When the intonation value is decremented by −1, it is checked in step 313 if the intonation value is equal to or larger than 4. If NO in step 313, the counter melody flag is cleared in step 314.

Figure 30:
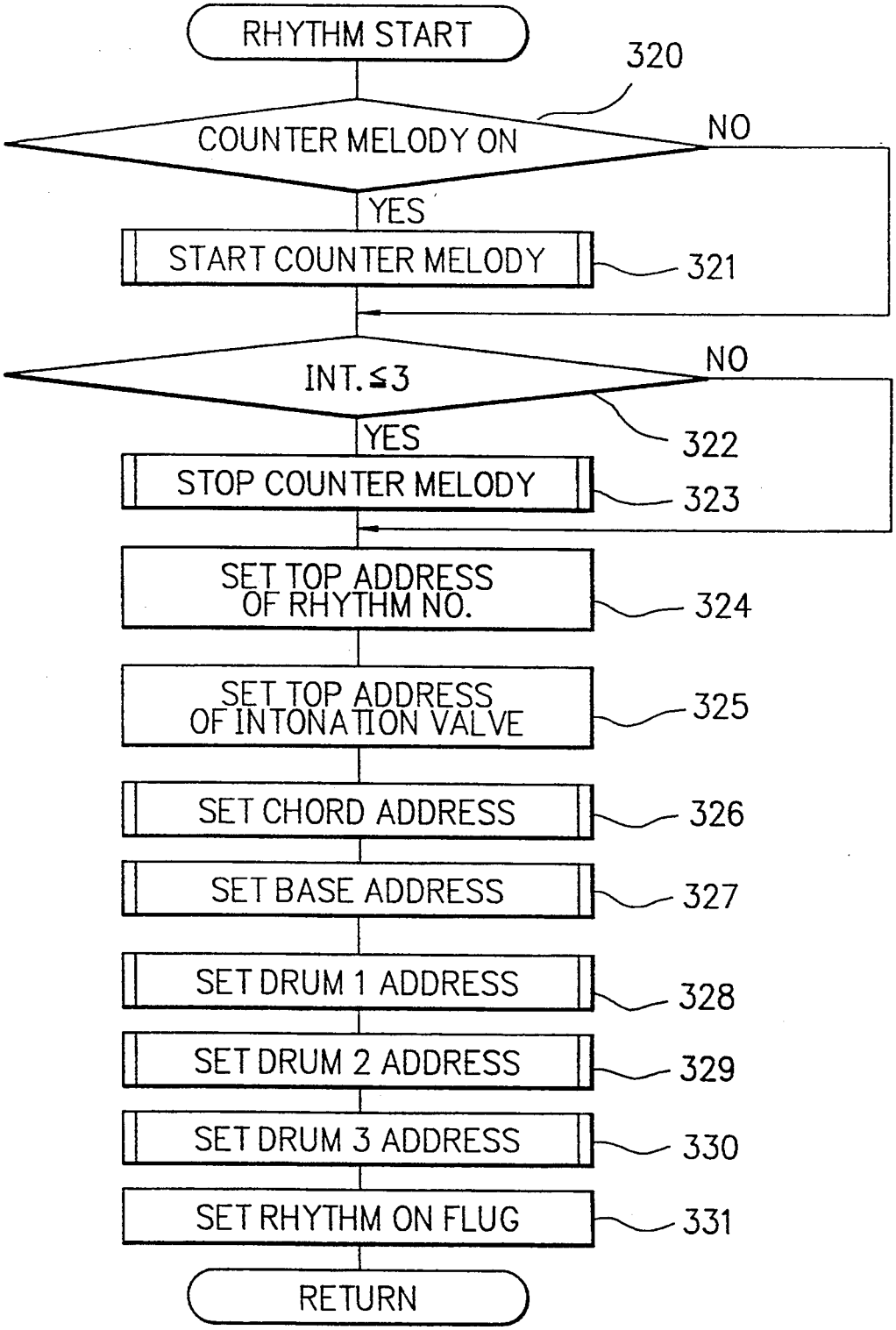

FIG. 30 shows the rhythm start routine in step 297 shown in FIG. 27. In step 320, it is checked if the counter melody flag is ON. If YES in step 320, the counter melody is started in step 321. Furthermore, it is checked in step 322 if the intonation value is equal to or smaller than 3. If YES in step 322, the counter melody is stopped in step 323. In step 324, the top address of intonation pattern data corresponding to the rhythm number is set. In step 325, the top address of intonation pattern data indicated by the current intonation value is set. In steps 326 to 330, read addresses of intonation pattern data for five tracks, i.e., chord, bass, and drum1 to drum3 tracks, are set, and corresponding data are read out to a buffer. In step 331, a rhythm ON flag is set.

Figure 31:
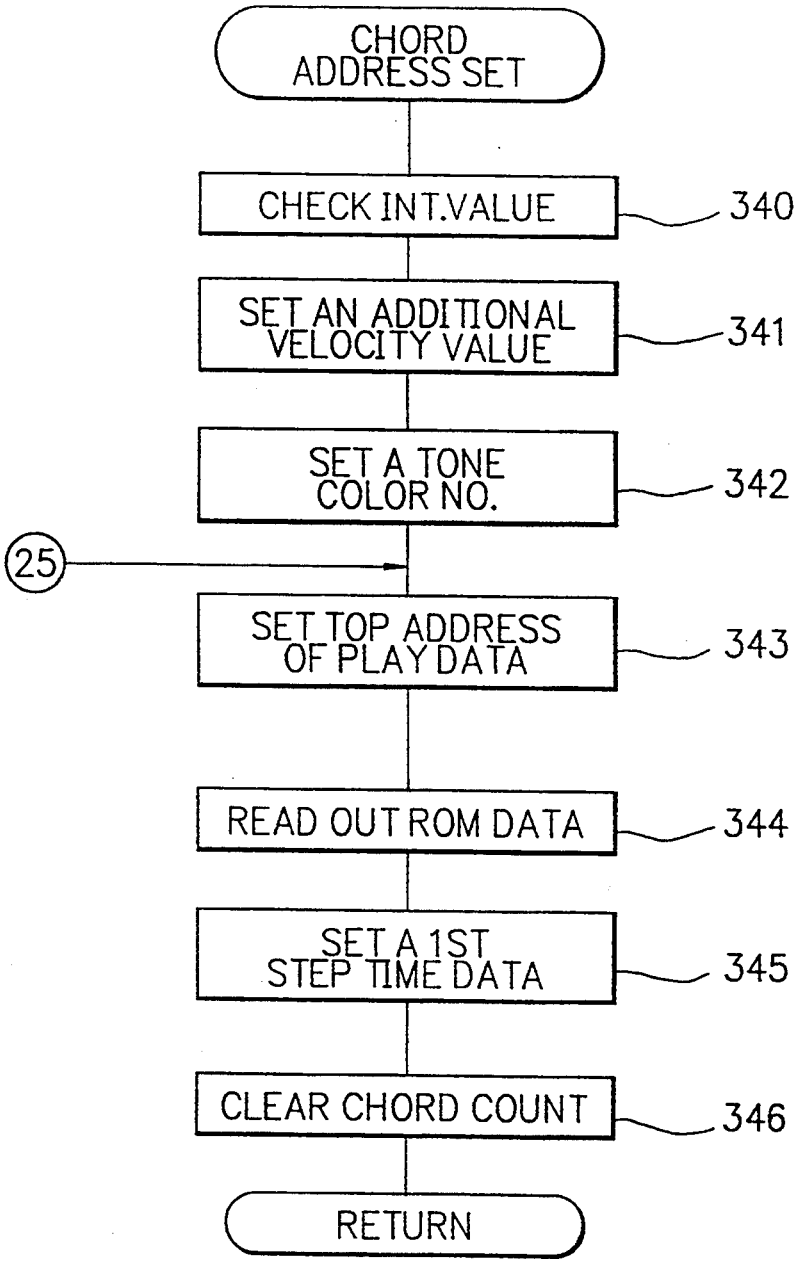

FIG. 31 shows in detail the chord address set routine shown in FIG. 30. In this routine, the intonation value is checked in step 340. In step 341, tone volume difference data of intonation pattern data is set as an additional velocity value. In step 342, a tone color number is set. In step 343, the top address of play pattern data is set. In step 344, note data of one tone corresponding to the top address of auto-play data is read out from the ROM 20, and the first step time data is set in a buffer in step 345. In step 346, a time base counter value of chord note data is cleared, and the flow returns to the main routine. Steps 327 to 330 for other channels in FIG. 30 are executed in the same manner as described above.

Figure 32:
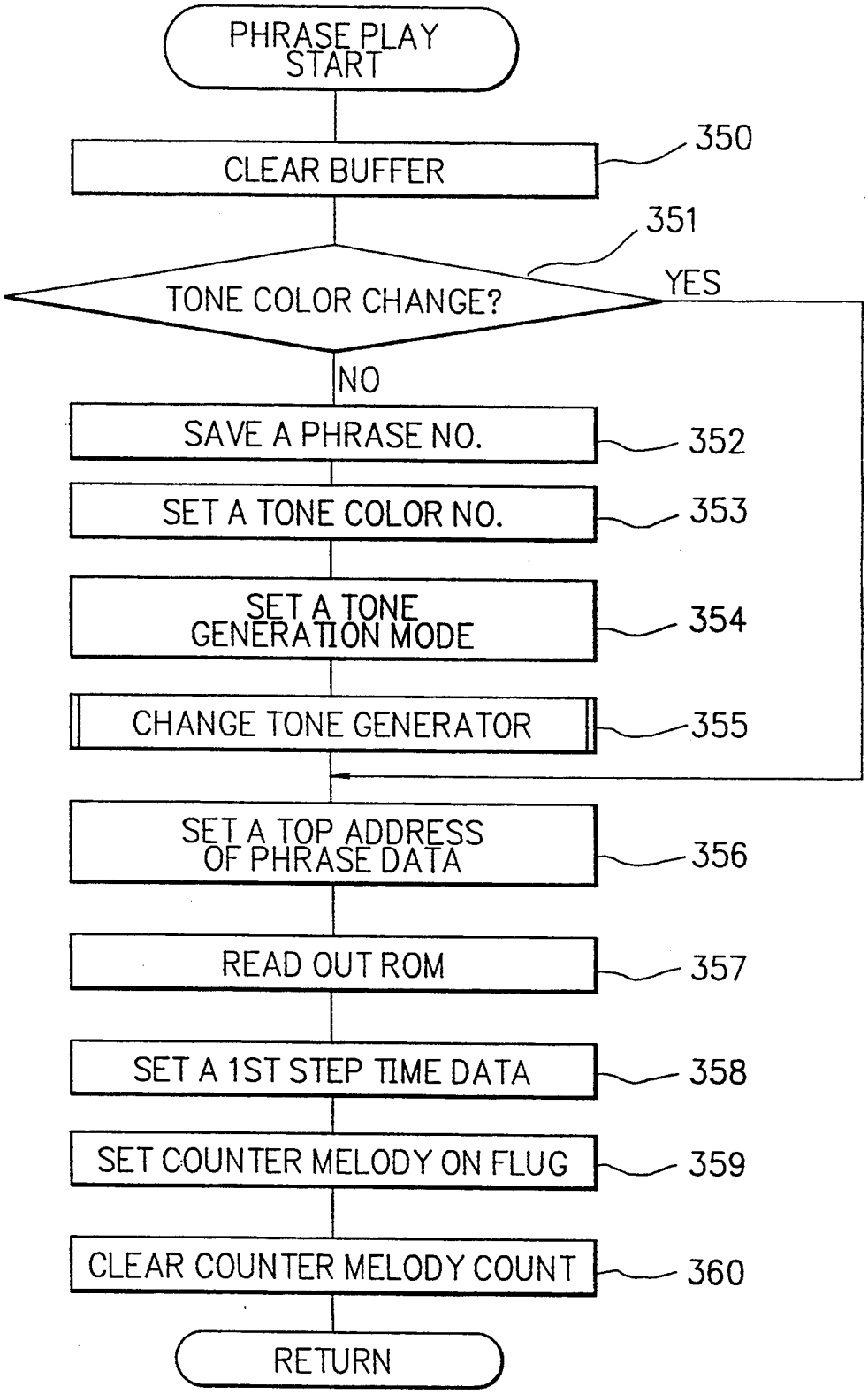

FIG. 32 shows processing when the adlib phrase play or counter melody play operation is started. In step 350, the buffer is cleared. In step 351, it is checked if the tone color is changed. If NO in step 351, a phrase number (a key number or a number assigned to a counter melody) is fetched in step 352. In step 353, a tone color number is set, and in step 354, a tone generation mode is set. In step 355, processing for changing a sound source of the tone generator is performed, and in step 356, the top address of phrase data is set. Thereafter, in step 357, ROM data is read out. In step 358, first step time data is set, and in step 359, the counter melody (phrase play) flag is set. In step 360, a time base counter of a counter melody (phrase play) is cleared.

Figure 33:
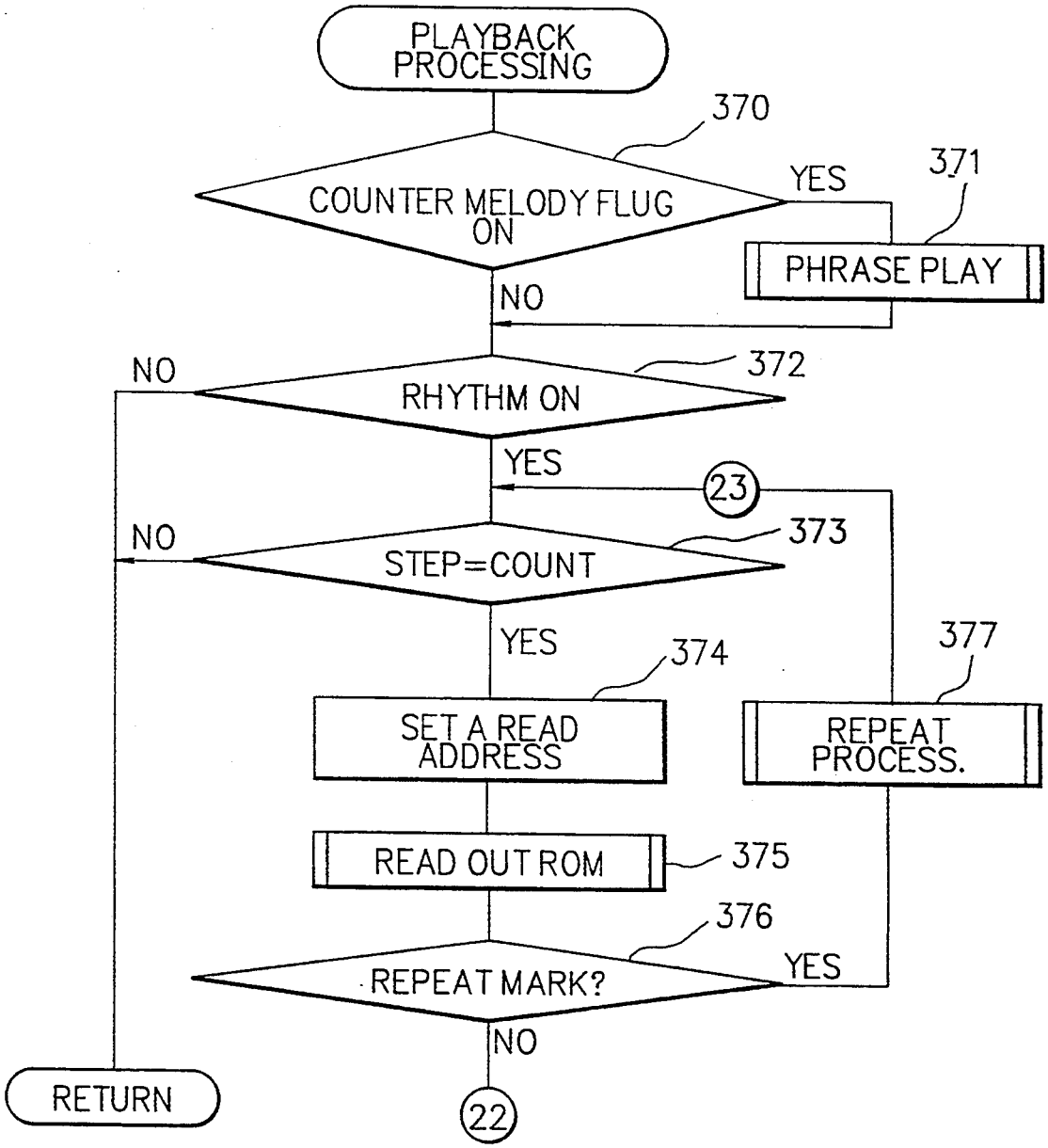
Figure 34:
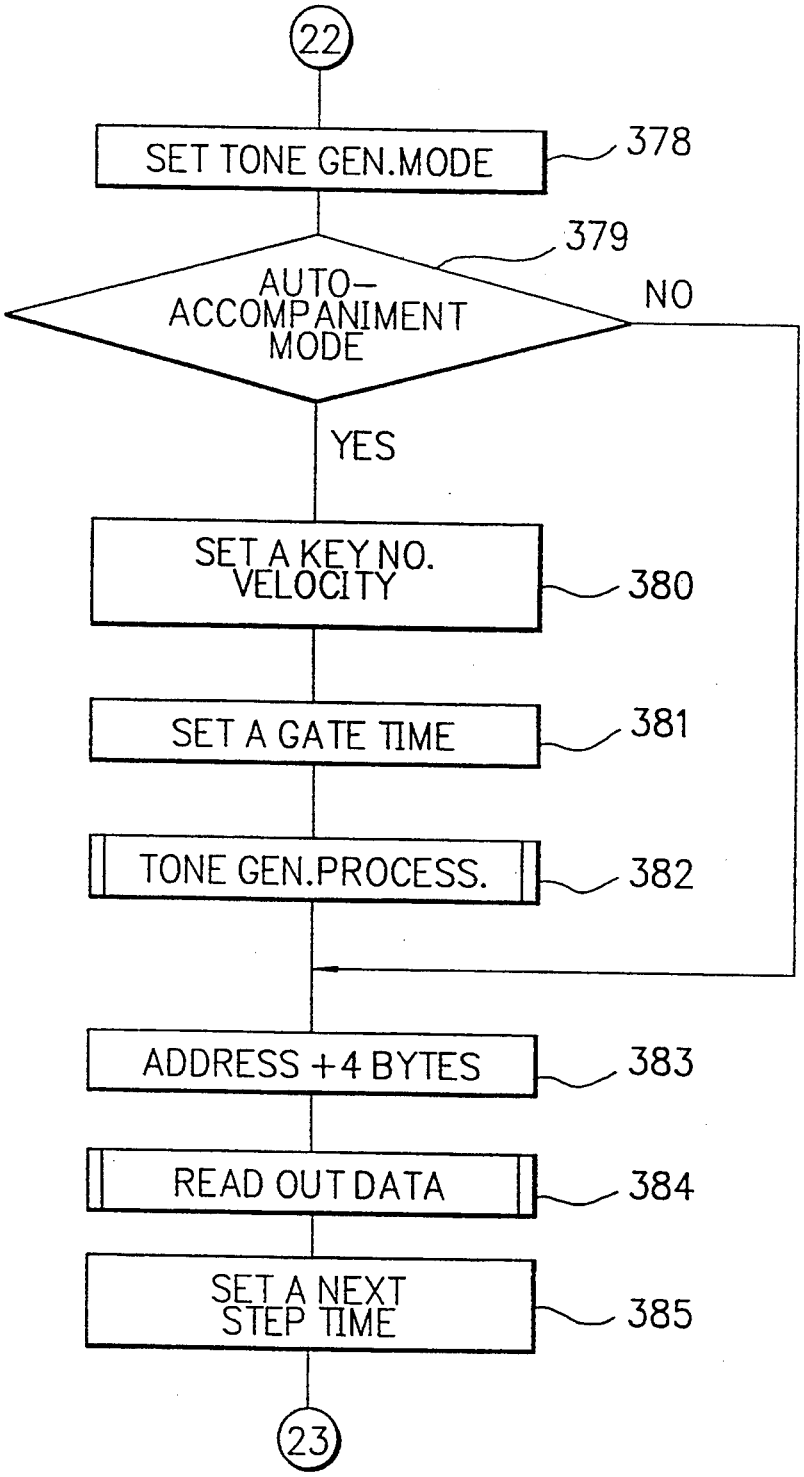

FIG. 33 shows auto-accompaniment note playback processing routine. In this routine, a counter melody ON flag is checked in step 370. If YES in step 370, a phrase or a counter melody is played back in step 371. If the counter melody ON flag is OFF, and if it is determined in step 372 that the rhythm flag is ON, accompaniment tones are played back. More specifically, it is checked in step 373 if the count value of the time base counter coincides with the step time in the buffer. If NO in step 373, the flow returns to the main routine.

If it is determined in step 373 that the count value of the time base counter coincides with the step time, a read address is set (step 374), and 4-byte note data is read out from the ROM 20. It is checked in step 376 if the readout note data is a repeat mark. If YES in step 376, repeat processing is executed in step 377, and the flow returns to a node before step 373. If it is determined in step 376 that the readout note data is normal note data, the flow advances to step 378 shown in FIG. 34, and the tone generation mode is set.

It is then checked in step 379 if the auto-accompaniment mode is set. If YES in step 379, a key number, a velocity value, and a gate time are respectively set in steps 380 and 381. In step 382, tone generation processing of a corresponding note is executed. Upon completion of the tone generation processing, the read address is advanced by 4 bytes in step 383, and note data to be generated next is read out from the ROM 20 in step 384. The next step time is set in the buffer, and the flow then returns to step 373 of the auto-play routine shown in FIG. 33. The above-mentioned processing is then repeated to sequentially generate auto-accompaniment tones.

Figure 35:
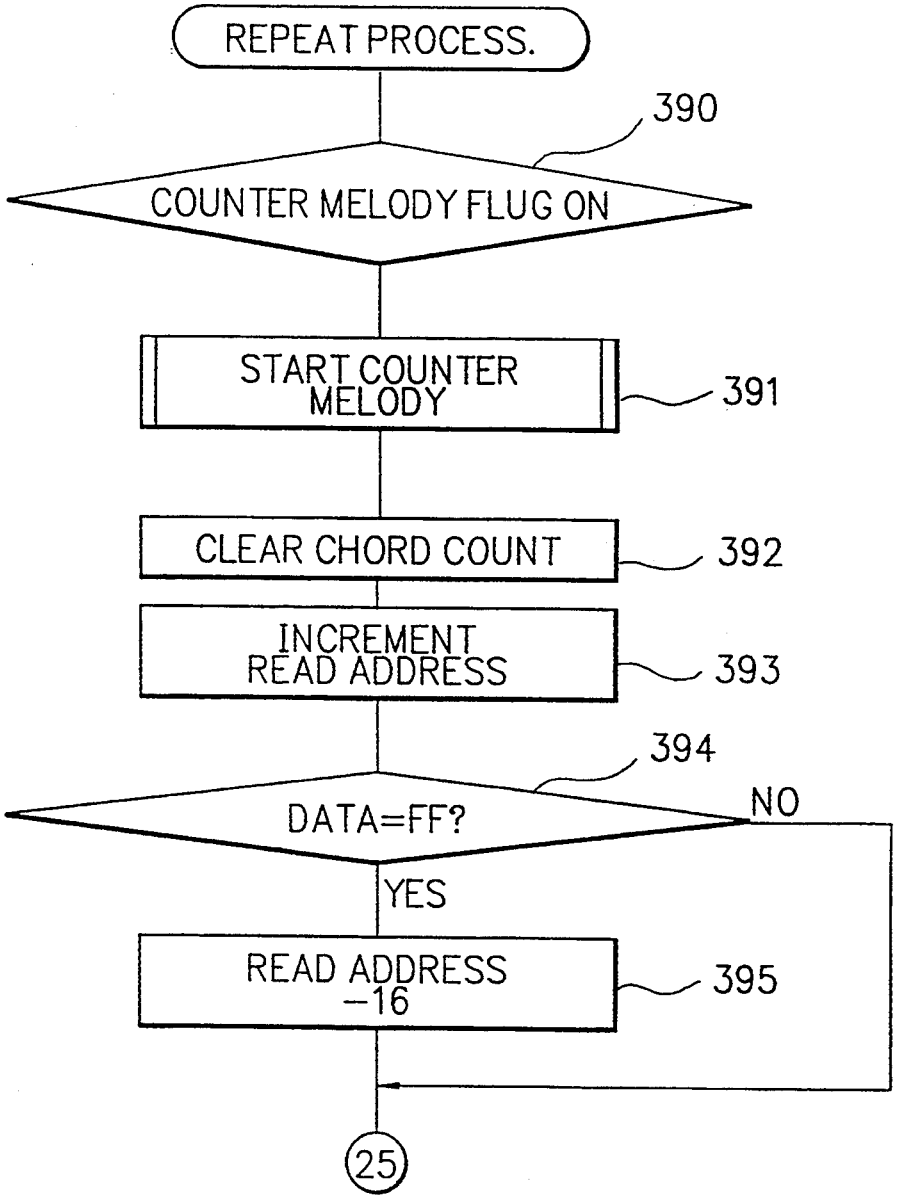

If it is determined in step 376 in FIG. 33 that a repeat mark at the end of note data is detected, the flow advances to step 377 to execute repeat processing shown in FIG. 35. In this routine, in step 390, a counter melody (phrase playback.) flag is checked. If YES in step 390, counter melody start processing is performed in step 391. In step 392, the time base counter of chord note data is cleared. In step 393, the read address of intonation pattern data is incremented by one. It is then checked in step 394 if the current auto-play pattern data is a repeat mark REP(FFH) shown in FIGS. 9 and 10. If NO in step 394, the flow returns to step 343 in FIG. 31, and the top address of an auto-play pattern for the next, i.e., second bar, is set, thus continuing a read operation of note data.

If it is determined in step 394 in FIG. 35 that the repeat mark REP(FFH) is detected, 16 is subtracted from the read address of intonation pattern data in step 395 to return the read position to the first beat of the first bar. Thus, the read operation of note data is continued from step 343 in FIG. 31.

Figure 36:
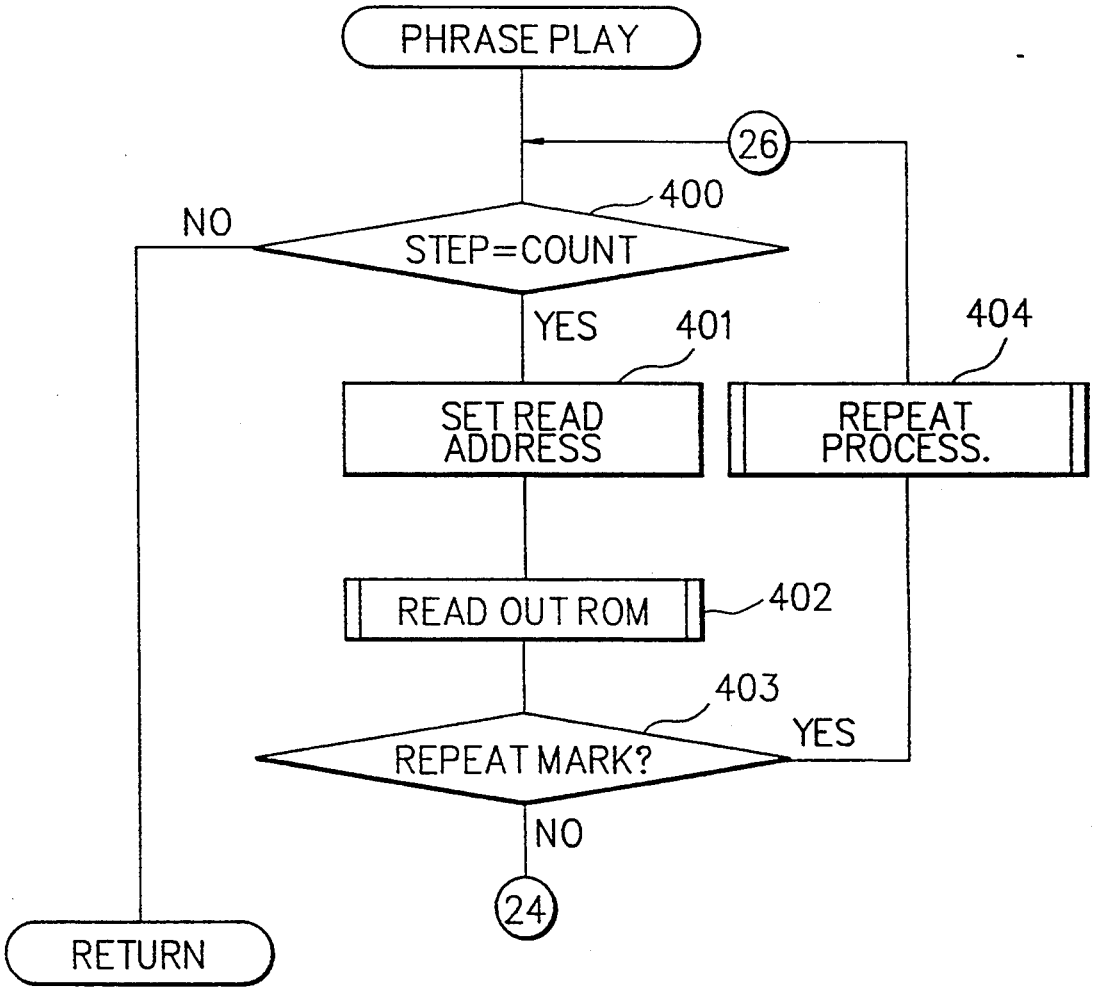
Figure 37:
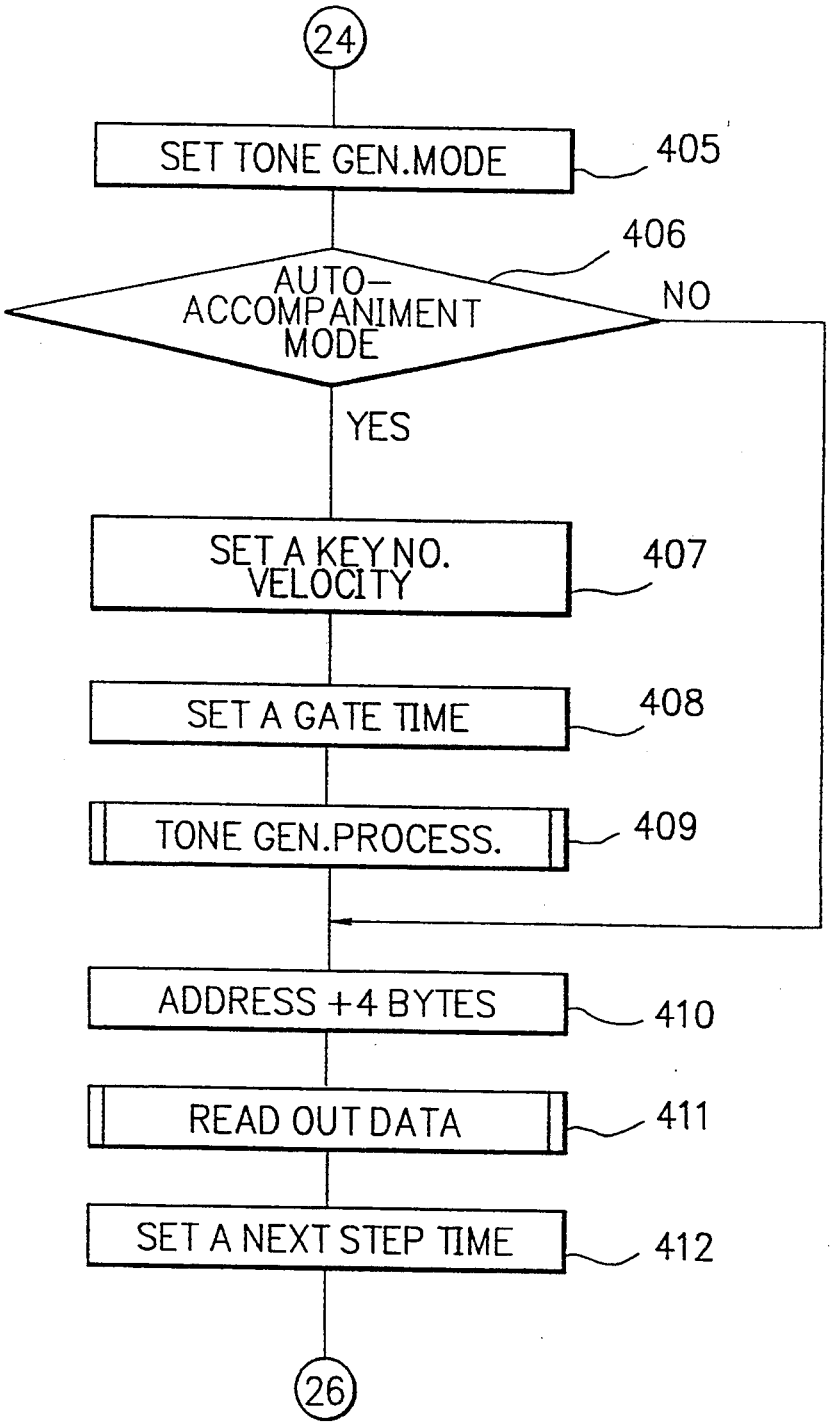
Figure 38:
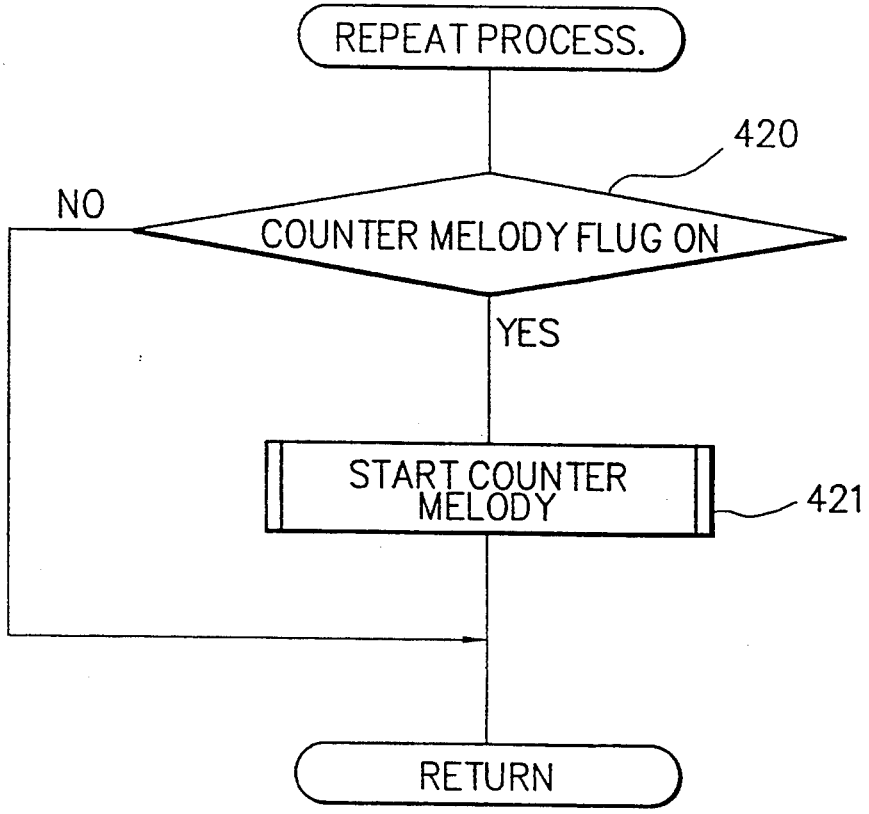

FIGS. 36 to 38 show the phrase play routine. In this routine, steps 400 to 412 are the same as steps 370 to 385 shown in FIGS. 33 and 34. The repeat processing is performed by starting a counter melody at the beginning of a bar when it is determined that the counter melody flag is ON (steps 420 and 421).

The auto-play apparatus of the present invention comprises a play pattern storage means for storing a plurality of play patterns of different short phrases. The apparatus selects the play pattern of the short phrases each assigned to a key in response to an operation of the key, or selects one of the play patterns when no key operation is made. The apparatus reads out a corresponding note data string on the basis of the selected play pattern, and generates tones. Therefore, when a player performs an adlib play operation for calling the play pattern of the short phrase in correspondence with the key operation, an interval between adjacent key operations can be filled with an auto-play operation of a predetermined phrase, thus toning up a performance. Since no special-purpose track need be added for the auto-play operation, a high-performance apparatus can be attained without increasing cost.

What is claimed is:

1. An auto-play apparatus for generating an auto-play tone controlled by one of a plurality of enhancement levels and a set of auto-play tone parameters, said plurality of enhancement levels being utilized as control values for modifying the set of auto-play tone parameters of the auto-play tone, said apparatus comprising:

single enhancement control means used by a player to increase/decrease the one of said plurality of enhancement levels for the auto-play tone to produce a changed enhancement level; and tone parameters change means for changing the set of auto-play tone according to the changed enhancement level from said enhancement control means;

said tone parameter change means comprising means for generating different sets of tone parameters for each of said plurality of enhancement levels to represent different tone-up stages of the auto-play tone.

2. The apparatus of claim 1, wherein said enhancement control means comprises a dial-like operation member.

3. The apparatus of claim 2, wherein said dial-like operation member is arranged at a left side of a keyboard.

4. The apparatus of claim 1, wherein said enhancement control means comprises an expression pedal.

5. The apparatus of claim 1, wherein the increased/-decreased one of said plurality of enhancement levels for the auto-play tone is modified according to a tone of a musical piece.

6. The apparatus of claim 1, further comprising numerical value information generation means for generating numerical value information representing the increased/decreased one of said plurality of enhancement levels of the auto-play tone;

said tone parameter change means changing each of the set of auto-play tone parameters according to the numerical value information.

7. The apparatus of claim 6, further comprising display means for displaying the numerical value information generated by said numerical value information generation means.

8. The apparatus of claim 6, said tone parameter change means including storage means for storing said plurality of enhancement levels, each having a different set of auto-play tone parameters; wherein the player selects the one of said plurality of enhancement levels via said enhancement control means.

9. The auto-play apparatus of claim 1, wherein the enhancement control means is a single enhancement level controller.

10. The auto-play apparatus of claim 1, further comprising:

storage means for storing a different set of tone parameters for each of said plurality of enhancement levels.

11. The auto-play apparatus of claim 1, wherein said tone parameter change means changes all auto-play tone parameters of the set of auto-play tone parameters at once.

12. The auto-play apparatus of claim 1, wherein the tone parameter change means changes different sets of tone parameters for different levels of auto-play tones.

13. An auto-play apparatus comprising:

note data storage means for storing note data strings for auto-play tones;

tone generation means for generating tones on the basis of a note data string read out from said note data storage means;

intonation pattern storage means for storing intonation patterns of a plurality of levels corresponding to a degree of tone-up of a performance;

intonation value setting means for setting an intonation value corresponding to the plurality of levels; and tone control means for controlling the note data string read out from said note data storage means on the basis of the intonation pattern data corresponding to the set intonation value, and outputting the controlled note data string to said tone generation means, wherein each of the intonation pattern data for each of the plurality of levels includes at least one of indication information for designating different read positions of said note data storage means, tone volume information, tone color information, instrument information for the note data string read out.

14. The apparatus of claim 13, wherein said intonation value setting means comprises operation means for increasing/decreasing the intonation value.

15. The apparatus of claim 14, wherein said operation means has a dial-like shape.

16. The apparatus of claim 13, wherein each of the intonation patterns includes a plurality of tone lines, each tone line including indication information for designating a read position of said note data storage means.

17. The apparatus of claim 16, wherein said plurality of tone lines includes chord, bass, and drum tone lines.

18. The apparatus of claim 17, wherein the drum tone line further includes a plurality of individual drum tone lines.

19. The apparatus of claim 16, wherein each of the intonation patterns includes a repeat mark at the end of the indication information for repetitively using the read position indication information to repetitively designate the read position of said note data storage means.

20. The apparatus of claim 13 or 16, wherein each of the intonation patterns includes a series of indication information for designating the read positions in a read order so as to read out the readout note data string over a plurality of bars.

21. The apparatus of claim 13, wherein each of the intonation patterns includes at least two of the indication information for indicating different read positions of said note data storage means, the tone volume information, the tone color information, and the instrument information, wherein at least one of these is common to the intonation patterns of the plurality of levels, and at least one of these is different among the intonation patterns of the plurality of levels.

22. The apparatus of claim 13, wherein each of the intonation patterns includes a plurality of tone systems, each tone system having at least one of the indication information for designating different read positions of said note data storage means, the tone volume information, the tone color information, and the instrument information, and the intonation patterns for each of the plurality of levels have different information in at least one of the indication information for designating different read positions of said note data storage means, the tone volume information, the tone color information and the instrument information, in at least one corresponding tone line.

23. The apparatus of claim 13, wherein the tone volume information is a difference value to the added to tone volume information of the readout note data string.

24. The apparatus of claim 13, wherein the instrument information is key information assigned to types of drums.

25. The apparatus of claim 24, wherein the key information includes specific key information of the readout note data string and key information to be replaced with the specific key information.

26. The apparatus of claim 13, wherein the intonation patterns with adjacent intonation levels have different information in at least one of the indication information for designating a read position of said note data storage means, the tone volume information, the tone color information, and the instrument information, and common information is omitted from the: intonation pattern of an adjacent intonation level.

27. The apparatus of claim 13, wherein the intonation patterns with adjacent intonation levels have different tone volume information and remaining common information are omitted from the intonation pattern of every other of the plurality of levels.

28. The apparatus of claim 13, wherein the intonation patterns are stored according to types of rhythms.

29. The apparatus of claim 13, further comprising preset value storage means for storing a preset value for the intonation value according to types of rhythms.

30. An auto-play apparatus comprising:

note data storage means for storing note data strings for an auto-play operation;

tone generation means for generating tones on the basis of a note data string read out from said note data storage means;

intonation value varying means for increasing/decreasing an intonation value in correspondence with a degree of tone-up of a musical performance;

play pattern storage means for storing a plurality of play patterns of short phrases having different degrees of tone-up; and tone control means for selecting one of the plurality of play patterns according to a magnitude of the intonation value, reading out a corresponding tone data string from said note data storage means on the basis of the selected play pattern, and outputting the readout note data string to said tone generation means.

31. The apparatus of claim 30, wherein said play pattern storage means comprises intonation pattern storage means for storing intonation patterns of a plurality of levels corresponding to a degree of tone-up of the musical performance, wherein the plurality of play patterns of the short phrases are stored in a portion of said intonation pattern storage means, said tone control means controls the readout note data string on the basis of an intonation pattern corresponding to the varied intonation value, and outputs the controlled note data string to said tone generation means, and the intonation patterns of the plurality of levels include at least one of indication information for indicating different read positions of said note data storage means, tone volume information, tone color information, and instrument information.

32. The apparatus of claim 30, further comprising a plurality of operation means for instructing insertion of one of the plurality of play patterns of short phrases, wherein at least one of said plurality of operation means is assigned to one of the plurality of play patterns corresponding to the magnitude of the intonation value, and the remaining operation means are assigned to the remaining of the plurality of play patterns, independent of the magnitude of the intonation value.

33. The apparatus of claim 30, wherein said intonation value varying means has a dial-like shape.

34. The apparatus of claim 31, wherein the intonation patterns are stored according to types of rhythms.

35. The apparatus of claim 30, further comprising present value storage means for storing a present value of the intonation value according to rhythms.

36. An auto-play apparatus comprising:

note data storage means for storing note data strings for an auto-play operation;

tone generation means for generating tones on the basis of a note data string read out from said note data storage means;

play pattern storage means for storing a plurality of play patterns of different short phrases;

intonation value varying means for varying an intonation value in correspondence with a degree of tone-up of a musical performance; and tone control means for selecting one of the plurality of play patterns assigned to a key in response to an operation of the key, selecting one of the plurality of play patterns when no key operation is performed, reading out a corresponding note data string from said note data storage means on the basis of the selected play pattern, and outputting the readout note data string to said tone generation means, wherein said tone control means selects one of the plurality of play patterns when the intonation value exceeds a predetermined value and no key operation is performed.

37. The apparatus of claim 36, further comprising intonation pattern storage means for storing intonation patterns of a plurality of levels corresponding to a degree of tone-up of the musical performance, and wherein said tone control means controls the note data string read out from said note data storage means on the basis of the intonation pattern data corresponding to the intonation value and outputs the controlled note data string to said tone generation means, and the intonation pattern data of a plurality of levels includes at least one of indication information for indicating different read positions of said note data storage means, tone volume information, tone color information, and instrument information.

38. The apparatus of claim 36, wherein the plurality of play patterns, are stored according to types of rhythms.

39. The apparatus of claim 36, further comprising operation means for turning on/off an adlib mode for selecting the one of the plurality of play patterns assigned to the key in response to the key operation, and wherein when the adlib mode is turned off, one of the plurality of play patterns is selected when the intonation value exceeds the predetermined value.

40. The apparatus of claim 36, wherein said intonation value varying means has a dial-like shape.

41. The apparatus of claim 37, wherein the intonation pattern data are stored according to types of rhythms.

42. The apparatus of claim 36, further comprising preset value storage means for storing a preset value of intonation value according to rhythms.

43. The apparatus of claim 36, wherein the one of the plurality of play patterns to be selected when no key operation is performed is assigned to a key.

44. The apparatus of claim 36, wherein the one of the plurality of play patterns to be selected when no key operation is performed is not assigned to a key.

45. An auto-play apparatus comprising:

keyboard means for generating a melody tone;

auto-accompaniment means for generating an auto-play tone from an initial auto-play pattern;

enhancement means for modifying a tone-up level of the auto-play tone;

auto-play pattern storage means for storing a plurality of auto-play patterns, each of said plurality of auto-play patterns corresponding to a different tone-up level of the melody tone, and each of said plurality of auto-play patterns including different tone intensity data, tone color data, and instrument data; and auto-accompaniment control means for selecting an optimal auto-play pattern from said plurality of auto-play patterns wherein the tone intensity data, the tone color data, and the instrument data of said optimal auto-play pattern optimally enhances the auto-play tone;

said auto-accompaniment means further generating the auto-play tone from said optimal auto-play pattern.

46. The apparatus of claim 45, wherein said enhancement control means comprises a dial-like operation member.

47. The apparatus according to claim 45, wherein said enhancement control means comprises an expression pedal.

48. The apparatus of claim 45, further comprising display means for displaying the tone intensity data, the tone color data, and instrument data of said optimal auto-play pattern.

* * * * *